US007243687B2

(12) United States Patent
Barratte

(10) Patent No.: US 7,243,687 B2
(45) Date of Patent: Jul. 17, 2007

(54) PAPERMAKER'S FORMING FABRIC WITH TWICE AS MANY BOTTOM MD YARNS AS TOP MD YARNS

(75) Inventor: Christine Barratte, Saint Claude (FR)

(73) Assignee: Weavexx Corporation, Wake Forest, NC (US)

( * ) Notice: Subject to any disclaimer, the term of this patent is extended or adjusted under 35 U.S.C. 154(b) by 159 days.

(21) Appl. No.: 10/862,782

(22) Filed: Jun. 7, 2004

(65) Prior Publication Data

US 2005/0268981 A1 Dec. 8, 2005

(51) Int. Cl.

| | |
|---|---|
| ***D21F 7/08*** | (2006.01) |
| ***D03D 1/00*** | (2006.01) |
| *D03D 25/00* | (2006.01) |
| *D03D 3/04* | (2006.01) |

(52) U.S. Cl. ..... 139/383 A; 162/348; 162/358.2

(58) Field of Classification Search ..... 139/383 A; 162/348, 902, 903; 442/206, 207
See application file for complete search history.

(56) References Cited

U.S. PATENT DOCUMENTS

| | | | |
|---|---|---|---|
| 2,172,430 | A | 9/1939 | Barrell |
| 2,554,034 | A | 5/1951 | Koester et al. |
| 3,094,149 | A | 6/1963 | Keily |
| 3,325,909 | A | 6/1967 | Clark |
| 4,093,512 | A | 6/1978 | Fleischer |
| 4,182,381 | A | 1/1980 | Gisbourne |
| 4,244,543 | A | 1/1981 | Ericson |
| 4,289,173 | A | 9/1981 | Miller |
| 4,290,209 | A | 9/1981 | Buchanan et al. |
| 4,414,263 | A | 11/1983 | Miller et al. |
| 4,438,788 | A | 3/1984 | Harwood |
| 4,452,284 | A | 6/1984 | Eckstein et al. |
| 4,453,573 | A | 6/1984 | Thompson |
| 4,501,303 | A | 2/1985 | Osterberg |
| 4,515,853 | A | 5/1985 | Borel |

(Continued)

FOREIGN PATENT DOCUMENTS

| | | |
|---|---|---|
| DE | 454 092 | 12/1927 |

(Continued)

OTHER PUBLICATIONS

International Search Report for PCT/US2004/008311.

(Continued)

*Primary Examiner*—Gary L. Welch
(74) *Attorney, Agent, or Firm*—Myers Bigel Sibley & Sajovec

(57) ABSTRACT

A papermaker's fabric includes a set of top machine direction yarns, a set of top cross machine direction yarns interwoven with the top machine direction yarns to form a top fabric layer, a set of bottom machine direction yarns, a set of bottom cross machine direction yarns interwoven with the bottom machine direction yarns to form a bottom fabric layer. The bottom fabric layer is stitched to the top fabric layer. The top machine direction yarns and the top cross machine direction yarns are interwoven in a series of repeat units and the bottom machine direction yarns and the bottom cross machine direction yarns are interwoven in a series of corresponding repeat units. Each repeat unit has twice the number of bottom machine direction yarns as the number of top machine direction yarns.

25 Claims, 24 Drawing Sheets

U.S. PATENT DOCUMENTS

| | | | |
|---|---|---|---|
| 4,529,013 | A | 7/1985 | Miller |
| 4,564,052 | A | 1/1986 | Borel |
| 4,564,551 | A | 1/1986 | Best |
| 4,592,395 | A | 6/1986 | Borel |
| 4,592,396 | A | 6/1986 | Borel et al. |
| 4,605,585 | A | 8/1986 | Johansson |
| 4,611,639 | A | 9/1986 | Bugge |
| 4,621,663 | A | 11/1986 | Malmendier |
| 4,633,596 | A | 1/1987 | Josef |
| 4,636,426 | A | 1/1987 | Fleischer |
| 4,642,261 | A | 2/1987 | Fearnhead |
| 4,676,278 | A | 6/1987 | Dutt |
| 4,705,601 | A | 11/1987 | Chiu |
| 4,709,732 | A | 12/1987 | Kinnunen |
| 4,729,412 | A | 3/1988 | Bugge |
| 4,731,281 | A | 3/1988 | Fleischer et al. |
| 4,739,803 | A | 4/1988 | Borel |
| 4,755,420 | A | 7/1988 | Baker et al. |
| 4,759,975 | A | 7/1988 | Sutherland et al. |
| 4,815,499 | A | 3/1989 | Johnson |
| 4,815,503 | A | 3/1989 | Borel |
| 4,909,284 | A | 3/1990 | Kositzke |
| RE33,195 | E | 4/1990 | McDonald et al. |
| 4,934,414 | A | 6/1990 | Borel |
| 4,941,514 | A | 7/1990 | Taipale |
| 4,942,077 | A | 7/1990 | Wendt et al. |
| 4,945,952 | A | 8/1990 | Vöhringer |
| 4,967,805 | A | 11/1990 | Chiu et al. |
| 4,987,929 | A | 1/1991 | Wilson |
| 4,989,647 | A | 2/1991 | Marchand |
| 4,989,648 | A | 2/1991 | Tate et al. |
| 4,998,568 | A | 3/1991 | Vohringer |
| 4,998,569 | A | 3/1991 | Tate |
| 5,022,441 | A | 6/1991 | Tate et al. |
| 5,025,839 | A | 6/1991 | Wright |
| 5,067,526 | A | 11/1991 | Herring |
| 5,074,339 | A | 12/1991 | Vohringer |
| 5,084,326 | A | 1/1992 | Vohringer |
| 5,092,372 | A | 3/1992 | Fitzka et al. |
| 5,101,866 | A | 4/1992 | Quigley |
| 5,116,478 | A | 5/1992 | Tate et al. |
| 5,152,326 | A | 10/1992 | Vohringer |
| 5,158,118 | A | 10/1992 | Tate et al. |
| 5,219,004 | A | 6/1993 | Chiu |
| 5,228,482 | A | 7/1993 | Fleischer |
| 5,277,967 | A | 1/1994 | Zehle et al. |
| 5,358,014 | A | 10/1994 | Kovar |
| 5,421,374 | A | 6/1995 | Wright |
| 5,421,375 | A | 6/1995 | Praetzel |
| 5,429,686 | A | 7/1995 | Chiu et al. |
| 5,437,315 | A | 8/1995 | Ward |
| 5,449,026 | A | 9/1995 | Lee |
| 5,454,405 | A | 10/1995 | Hawes |
| 5,456,293 | A | 10/1995 | Ostermayer et al. |
| 5,465,764 | A | 11/1995 | Eschmann et al. |
| 5,482,567 | A | 1/1996 | Barreto |
| 5,487,414 | A | 1/1996 | Kuji et al. |
| 5,518,042 | A | 5/1996 | Wilson |
| 5,520,225 | A | 5/1996 | Quigley et al. |
| 5,542,455 | A | 8/1996 | Ostermayer et al. |
| 5,555,917 | A | 9/1996 | Quigley |
| 5,564,475 | A | 10/1996 | Wright |
| 5,641,001 | A | 6/1997 | Wilson |
| 5,651,394 | A | 7/1997 | Marchand |
| 5,709,250 | A | 1/1998 | Ward et al. |
| RE35,777 | E | 4/1998 | Givin |
| 5,746,257 | A | 5/1998 | Fry |
| 5,826,627 | A | 10/1998 | Seabrook et al. |
| 5,857,498 | A | 1/1999 | Barreto et al. |
| 5,881,764 | A | 3/1999 | Ward |
| 5,894,867 | A | 4/1999 | Ward et al. |
| 5,899,240 | A | 5/1999 | Wilson |
| 5,937,914 | A | 8/1999 | Wilson |
| 5,967,195 | A | 10/1999 | Ward |
| 5,983,953 | A | 11/1999 | Wilson |
| 6,073,661 | A | 6/2000 | Wilson |
| 6,112,774 | A | 9/2000 | Wilson |
| 6,123,116 | A | 9/2000 | Ward et al. |
| 6,145,550 | A | 11/2000 | Ward |
| 6,148,869 | A | 11/2000 | Quigley |
| 6,158,478 | A | 12/2000 | Lee et al. |
| 6,179,965 | B1 | 1/2001 | Cunnane et al. |
| 6,202,705 | B1 | 3/2001 | Johnson et al. |
| 6,207,598 | B1 | 3/2001 | Lee et al. |
| 6,227,255 | B1 | 5/2001 | Osterberg et al. |
| 6,237,644 | B1 | 5/2001 | Hay et al. |
| 6,240,973 | B1 | 6/2001 | Stone et al. |
| 6,244,306 | B1 | 6/2001 | Troughton |
| 6,253,796 | B1 | 7/2001 | Wilson et al. |
| 6,276,402 | B1 | 8/2001 | Herring |
| 6,379,506 | B1 | 4/2002 | Wilson et al. |
| 6,581,645 | B1 | 6/2003 | Johnson et al. |
| 6,585,006 | B1 | 7/2003 | Wilson et al. |
| 6,837,277 | B2 * | 1/2005 | Troughton et al. ..... 139/383 A |
| 7,001,489 | B2 * | 2/2006 | Taipale et al. ..... 162/348 |
| 2003/0010393 | A1 | 1/2003 | Kuji |
| 2004/0079434 | A1 | 4/2004 | Martin et al. |
| 2004/0102118 | A1 * | 5/2004 | Hay et al. ..... 442/239 |

FOREIGN PATENT DOCUMENTS

| | | | |
|---|---|---|---|
| DE | 3318960 | A1 | 11/1984 |
| DE | 33 29 740 | | 3/1985 |
| EP | 0 048 962 | | 9/1981 |
| EP | 0 158 710 | | 10/1984 |
| EP | 0 185 177 | | 10/1985 |
| EP | 0 224 276 | | 12/1986 |
| EP | 0 264 881 | | 10/1987 |
| EP | 0 269 070 | | 11/1987 |
| EP | 0 284 575 | | 2/1988 |
| EP | 0 283 181 | | 3/1988 |
| EP | 0 350 673 | | 6/1989 |
| EP | 0 408 849 | A2 | 5/1990 |
| EP | 0 408 849 | A3 | 5/1990 |
| EP | 0 672 782 | | 3/1995 |
| EP | 0 794 283 | A1 | 9/1997 |
| FR | 2 597 123 | | 4/1986 |
| GB | 2157328 | A | 10/1985 |
| GB | 2245006 | | 2/1991 |
| JP | 8-158285 | | 12/1994 |
| WO | WO 86/00099 | | 1/1986 |
| WO | WO 89/09848 | | 4/1989 |
| WO | WO 03/10304 | | 11/1992 |
| WO | WO 99/61698 | | 5/1999 |
| WO | WO 02/00996 | | 1/2002 |
| WO | WO 03/093573 | A1 | 11/2003 |

OTHER PUBLICATIONS

International Search Report for PCT Application No. PCT/US97/18629.

Rule 132 Declaration of Robert G. Wilson (Jun. 26, 1997).

Warren, C.A., "The Importance of Yarn Properties in Wet-End Wire Construction," Seminar, The Theory of Water Removal, Dec. 12, 1979.

European Search Report for European Application No. 05 00 2306 dated Oct. 6, 2005.

European Search Report corresponding to application No. EP 05002306.8, dated Oct. 18, 2005.

* cited by examiner

PAPERMAKER'S FORMING FABRIC WITH TWICE AS MANY BOTTOM MD YARNS AS TOP MD YARNS

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's fabric, typically the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are typically important considerations in papermaking, especially for the forming section of the papermaking machine, where the wet web is initially formed. Wire marking is particularly problematic in the formation of fine paper grades, as it can affect a host of paper properties, such as sheet mark, porosity, "see through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially the skew resistance, propensity for narrowing and stiffness), which may negatively impact both the service life and the performance of the fabric.

To combat these problems associated with fine weaves, multi-layer forming fabrics have been developed with fine-mesh yarns on the paper-forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarns as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 5,967,195, and 6,145,550 to Ward, and U.S. Pat. No. 6,244,306 to Troughton, the disclosures of which are hereby incorporated by reference in their entirety.

Although these fabrics have performed successfully in many applications, there is a trend toward finer yarns on the paper side of the fabric. However, because the tensile resistance of a yarn is proportional to the square of its diameter, as finer yarns are employed, the paper side layer of the fabric can become weaker. As such, it would be desirable to provide a fabric that has sufficient drainage, particularly on the paper side, and can still provide adequate fiber support for the production of many types of paper.

SUMMARY OF THE INVENTION

The present invention is directed to papermaker's fabrics that can address some of the drainage, wear, and abrasion issues noted above. In certain embodiments according to the present invention, a papermaker's fabric includes a set of top machine direction yarns, a set of top cross machine direction yarns interwoven with the top machine direction yarns to form a top fabric layer, a set of bottom machine direction yarns, and a set of bottom cross machine direction yarns interwoven with the bottom machine direction yarns to form a bottom fabric layer. The bottom fabric layer is stitched to the top fabric layer. The top machine direction yarns and the top cross machine direction yarns are interwoven in a series of repeat units and the bottom machine direction yarns and the bottom cross machine direction yarns are interwoven in a series of corresponding repeat units. Each repeat unit has twice the number of bottom machine direction yarns as the number of top machine direction yarns. In this configuration, the tensile strength and resistance in the machine direction can be provided by the additional bottom machine direction yarns.

In other embodiments according to the present invention, a papermaker's fabric includes top machine direction yarns, top cross machine direction yarns, bottom machine direction yarns, bottom cross machine direction yarns and stitching yarns. The fabric is formed in a plurality of repeating units, each of the repeating units including a set of eight top machine direction yarns, a set of top cross machine direction yarns interwoven with the set of top machine direction yarns to form a top fabric layer, a set of sixteen bottom machine direction yarns, a set of eight bottom cross machine direction yarns interwoven with the set of bottom machine direction yarns to form a bottom fabric layer, and sets of first and second stitching yarns interwoven with the top and bottom fabric layers.

In other embodiments of the present invention, embodiments of the papermaker's fabrics described above may be used to make paper. A paper stock may be applied to a papermaker's fabric as described above, and moisture may be removed from the paper stock to produce paper.

DETAILED DESCRIPTION OF EMBODIMENTS OF THE INVENTION

The present invention will now be described more particularly hereinafter with reference to the accompanying drawings, in which preferred embodiments of the invention are shown. The invention may, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some elements and the spacing between elements may be exaggerated for clarity.

Figure 1:
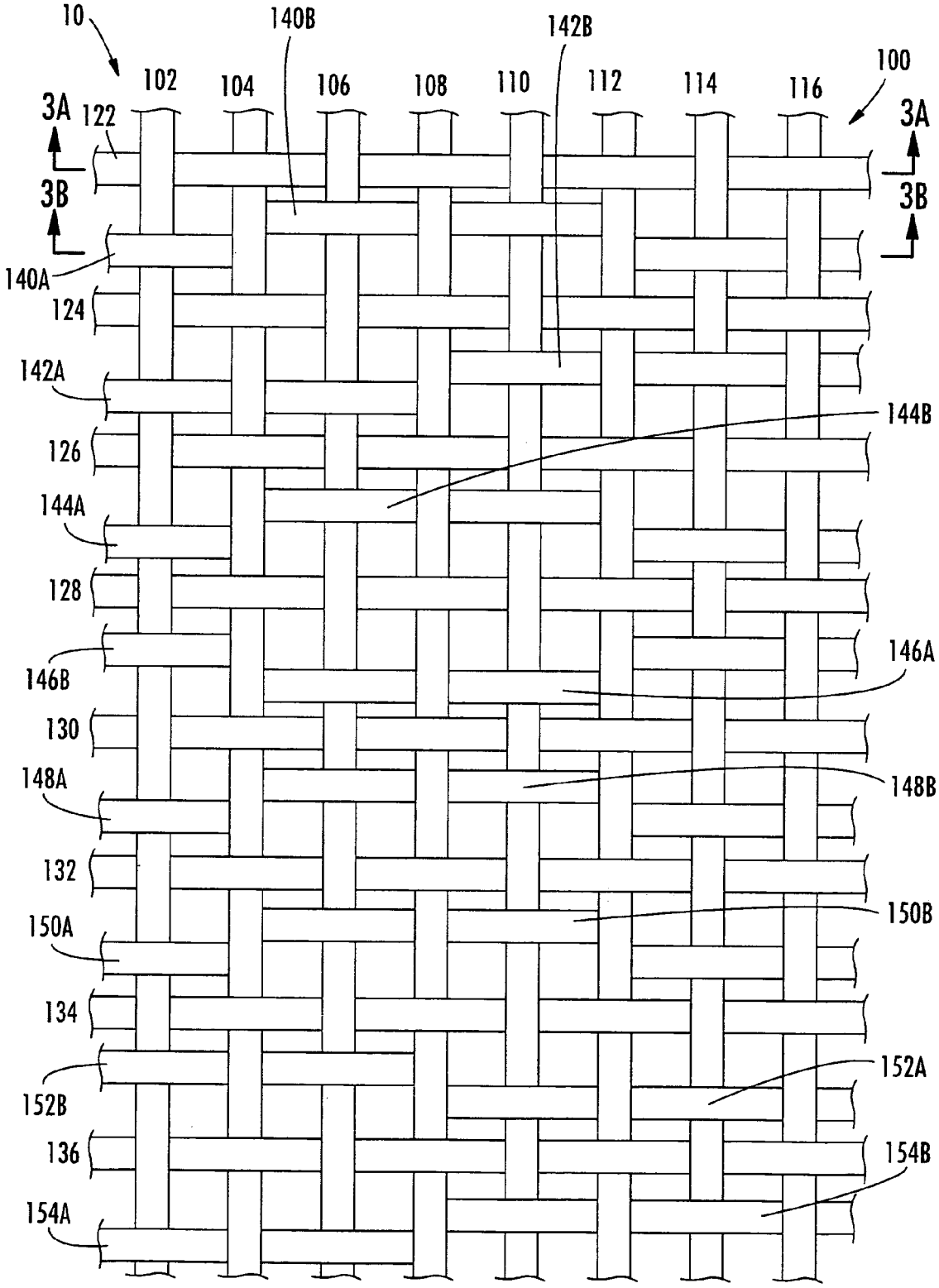
FIG. 1 is a top view of the top layer of a twenty-four harness triple layer papermaker's forming fabric according to embodiments of the present invention.
Figure 2:
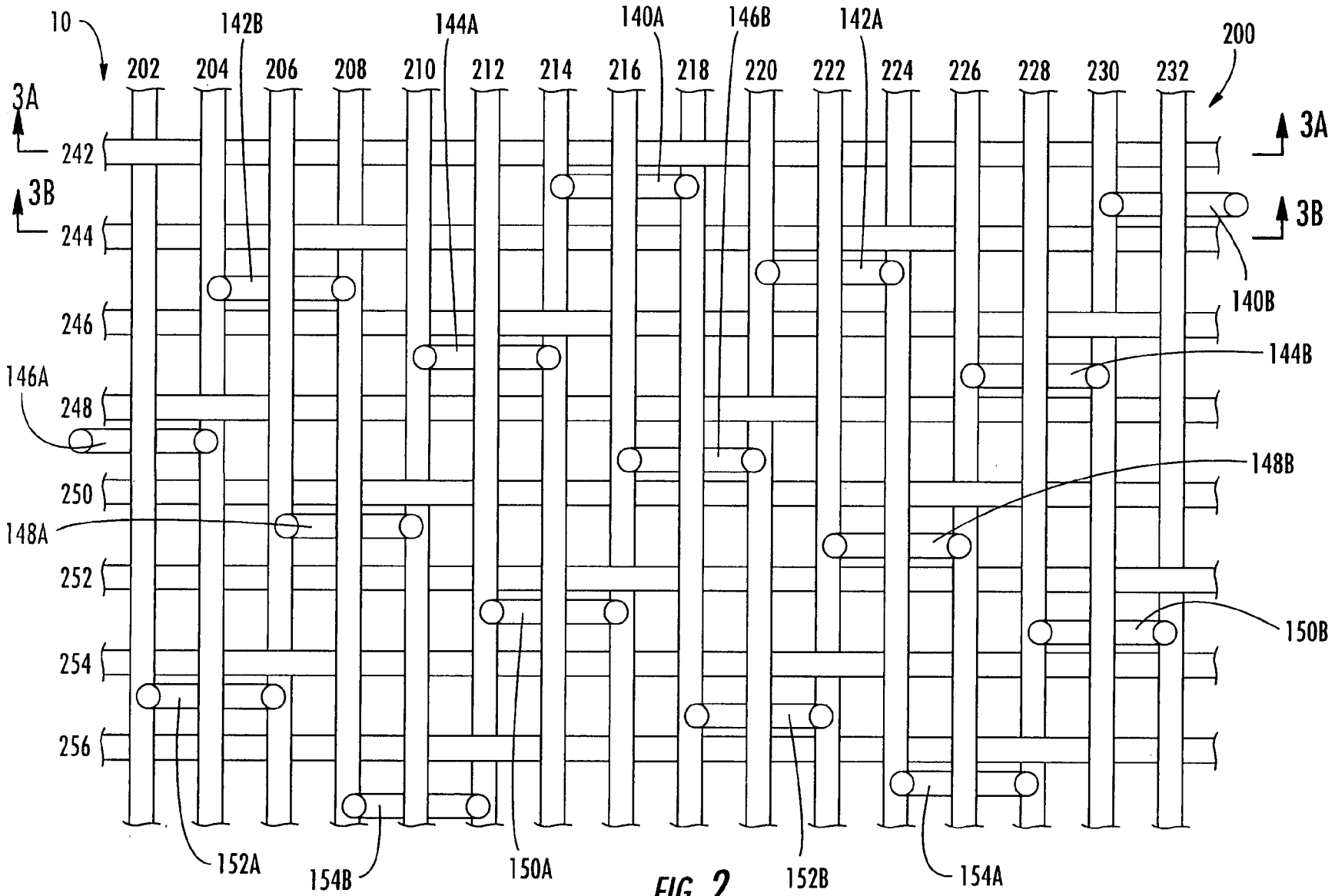
FIG. 2 is a top view of the bottom layer of the fabric of FIG. 1 with the top layer removed.

A twenty-four harness triple layer forming fabric, generally designated at 10, is illustrated in FIGS. 1, 2 and 3A–3B in which a single repeat unit of the fabric 10 is shown. The repeat unit of the fabric 10 includes a top layer 100 (FIG. 1) and a bottom layer 200 (FIG. 2). The top layer 100 and a bottom layer 200 are stitched together by stitching yarn pairs 140A, 140B, 142A, 142B, 144A, 144B, 146A, 146B, 148A, 148B, 150A, 150B, 152A, 152B, 154A, and 154B. Although FIGS. 1 and 2 only show a single repeat unit of the fabric 10, those of skill in the art will appreciate that in commercial-sized fabrics the repeat unit shown in FIGS. 1 and 2 would be repeated many times, in both the machine and cross machine directions, to form a large fabric suitable for use on a papermaking machine.

Referring to FIG. 1, the top layer 100 includes eight top MD yarns 102, 104, 106, 108, 110, 112, 114, and 116 and eight top CMD yarns 122, 124, 126, 128, 130, 132, 134, and 136. Referring to FIG. 2, the bottom layer 200 of the fabric 10 includes sixteen bottom MD yarns 202, 204, 206, 208, 210, 212, 214, 216, 218, 220, 222, 224, 226, 228, 230, and 232, which are interwoven with eight bottom CMD yarns 242, 244, 246, 248, 250, 252, 254, and 256.

As can also be seen with respect to FIGS. 1, 2 and 3A–3B, there are twice as many bottom MD yarns as top MD yarns. In this configuration, the top fabric layer can provide increased drainage of water and other liquids through the fabric. The top layer 100 includes a relatively large number of supportive top CMD yarns and stitching yarns in the cross machine direction, but also includes a relatively small number of top MD yarns to provide an open warp. The bottom layer 200 includes a relatively large number of bottom MD yarns that can increase durability and tensile resistance of the fabric 10.

As illustrated, the repeat unit of the fabric 10 is configured so that every other bottom MD yarn is positioned substantially directly below a corresponding top MD yarn, although weave patterns in which such is not the case are possible. For example, as illustrated in FIGS. 3A–3B, bottom MD yarn 202 is positioned substantially directly below top MD yarn 102, bottom MD yarn 204 is positioned between top MD yarns 102 and 104, and bottom MD yarn 206 is substantially beneath top MD yarn 104, and so forth for the remaining top and bottom MD yarns.

As shown in FIG. 1, the top MD yarns are interwoven with the top CMD yarns and the stitching yarns in an alternating "over 1/under 1" pattern to form a plain weave pattern. For example, top MD yarn 102 passes over top CMD yarn 122, under stitching yarn 140A, over top CMD yarn 124, and so forth until it passes under top stitching yarn 154A. An adjacent top MD yarn 104 passes under top CMD yarn 122, over stitching yarns 140A and 140B, under top CMD yarn 124, and so forth until it passes over top stitching yarn 154A. Thus, adjacent top MD yarns are offset from one another by one top CMD yarn. As illustrated, upper portions of the stitching yarn pairs 140A, 140B, 142A, 142B, 144A, 144B, 146A, 146B, 148A, 148B, 150A, 150B, 152A, 152B, 154A, and 154B form an integral part of the plain weave pattern of the top layer. Accordingly, the top layer can include stitching yarns, which form an integral part of the top layer.

Figure 3A:
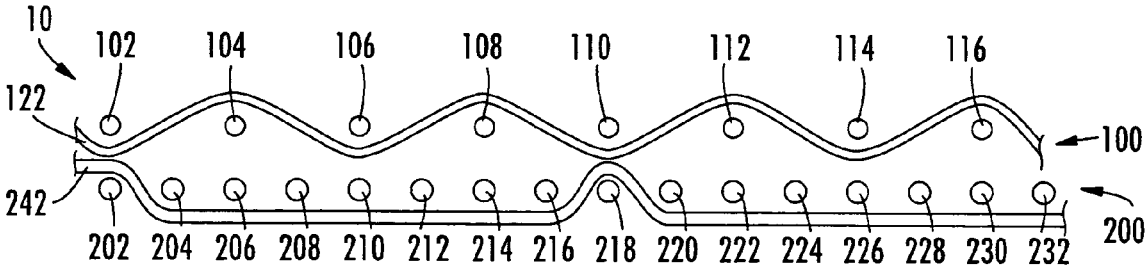
FIG. 3A is a section view of an exemplary top and bottom CMD yarn taken along lines 3A—3A of FIGS. 1 and 2 of the fabric thereof.
Figure 3B:
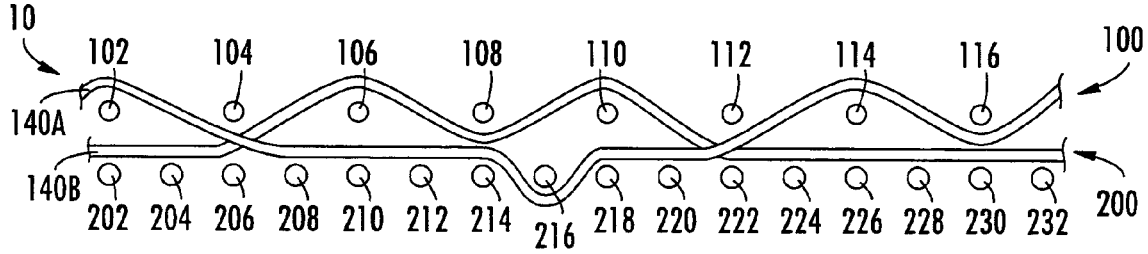
FIG. 3B is a section view of an exemplary pair of stitching yarns taken along lines 3B—3B of FIGS. 1 and 2.

Referring to FIGS. 2 and 3A, the bottom MD yarns are interwoven with the bottom CMD yarns in a pattern in which each bottom CMD yarn passes over one bottom MD yarn, under seven adjacent bottom MD yarns, over one bottom MD yarn, and under seven adjacent bottom MD yarns. For example, bottom CMD yarn 242 passes over bottom MD yarn 202, under bottom MD yarns 204,206, 208, 210, 212, 214, and 216, over bottom MD yarn 218, and under bottom MD yarns 220,222,224, 226, 228, 230, and 232. The other bottom CMD yarns follow the same "under 1/over 7" weave pattern, but each is offset in its weaving sequence from its nearest bottom CMD yarn neighbors by three bottom MD yarns. For example, bottom CMD yarn 244, which is adjacent bottom CMD yarn 242, passes over bottom MD yarn 208, under bottom MD yarns 210, 212, 214, 216, 218, 220, and 222, over bottom MD yarn 224, and under bottom MD yarns 226, 228, 230, 202, 204, and 206. Thus, the bottom MD "knuckle" formed by bottom MD yarn 202 as it passes below bottom CMD yarn 242 is offset from the bottom "knuckle" formed by bottom MD yarn 208 as it passes below bottom CMD yarn 244 by three bottom MD yarns.

As illustrated in FIGS. 1 and 2, the stitching yarn pairs 140A, 140B, 142A, 142B, 144A, 144B, 146A, 146B, 148A, 148B, 150A, 150B, 152A, 152B, and 154B are positioned between adjacent pairs of top CMD yarns and bottom CMD yarns such that each stitching yarn pair is separated from an adjacent stitching yarn pair by one top and one bottom CMD yarn. For example, stitching yarn pair 140A, 140B is separated from stitching yarn pair 142A, 142B by top CMD yarn 124 and bottom CMD yarn 244.

Corresponding pairs of stitching yarns in fabric 10 interweave with the top MD yarns and bottom MD yarns in the following pattern. Each of the stitching yarns of the repeat unit can be subdivided into two portions: a fiber support portion which interweaves with the top MD yarns, and a binding portion which interweaves a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned substantially above the binding portion of the other yarn of the pair. The fiber support portion of the stitching yarn of each pair interweaves in an alternating fashion with three top MD yarns in an "over 1/under 1/over 1" pattern as the other stitching yarn of the pair forms a binding knuckle with one bottom MD yarn.

For example, in FIG. 3B, stitching yarn 140A passes over top MD yarn 114, under top MD yarn 116, over top MD yarn 102, and intersects with stitching yarn 140B beneath transitional top MD yarn 104 and above bottom MD yarn 206. Beneath this fiber support portion of stitching yarn 140A, which forms the "over 1/under 1/under 1" pattern with top MD yarns 114, 116, and 102, stitching yarn 140B passes over bottom MD yarns 224, 226, 228, and 230, under bottom MD yarn 232, and over bottom MD yarns 202 and 204 to form a binding knuckle at bottom MD yarn 232. The pattern for stitching yarns 140A and 140B is reversed for top MD yarns 106, 108, 110, and 112, where the fiber support portion of the stitching yarn 140B is located, and bottom MD yarns 208, 210, 212, 214, 216, 218, and 220, where the binding portion of stitching yarn 140A is located. Thus, each stitching yarn forms an "over 1/under 1/over 1" pattern with three top MD yarns.

Thus, each set of stitching yarns is interwoven in a series of repeat units in which the stitching yarns pass below bottom machine direction yarns to form bottom stitching yarn knuckles. The bottom stitching yarn knuckles between a common pair of cross machine direction yarns are offset by eight bottom machine direction yarns. For example, as discussed above, stitching yarn 140A passes under bottom MD yarn 216 to form a bottom stitching yarn knuckle and stitching yarn 140B passes under bottom MD yarn 232 to form another bottom stitching yarn knuckle that is separated by the knuckle at bottom MD yarn 216 by seven bottom MD yarns.

Referring to FIG. 2, bottom stitching yarn knuckles of stitching yarns are offset from their adjacent stitching yarn pairs by three bottom machine direction yarns. For example, stitching yarn pair 140A, 140B forms bottom stitching yarn knuckles at bottom MD yarns 216 and 232, respectively. Adjacent stitching yarn pair 142A, 142B forms bottom stitching yarn knuckles at bottom MD yarns 222 and 206. The knuckle formed by stitching yarn 140A and bottom MD yarn 216 is offset by the knuckle formed by stitching yarn 142A and bottom MD yarn 222 by three bottom MD yarns 218, 220 and 222. Likewise, the knuckle formed by stitching yarn 140B and bottom MD yarn 232 is offset by the knuckle formed by stitching yarn 142B and bottom MD yarn 206 by three bottom MD yarns 202, 204 and 206.

In assessing the tensile resistance provided by a forming fabric, one can assign a "warp resistance factor" ("WRF") that provides a relative measurement of the resistance of the fabric based on its yarn construction. One can calculate a WRF as follows:

$$WRF=D_T^2N_T+D_B^2N_B$$

where $D_T$ is the diameter of the top MD yarns in mm, $N_T$ is the number of top MD yarns/cm, $D_B$ is the diameter of the bottom MD yarns in mm, and $N_B$ is the number of bottom MD yarns/cm. Using, for example, a typical triple layer fabric having 32 top MD yarns of 0.13 mm diameter per centimeter of width and 32 bottom MD yarns of 0.17 mm diameter per centimeter of width, the WRF can be calculated as 1.47. Fabrics according to embodiments of the present invention may have a WRF of between about 1.2 and about 3.0. Inasmuch as this fabric has proven to be successful in the field, a fabric with similar WRF or higher should have sufficient tensile resistance. It is noted that this calculation assumes that the yarns being compared are made from the same material or materials having similar tensile resistance.

Applying this calculation to the fabric 10 of FIGS. 1, 2 and 3A–3B, it can be seen that, for a fabric with 25 top MD yarns of 0.12 mm diameter per centimeter and 50 bottom MD yarns of 0.15 mm diameter per centimeter, the WRF can be calculated as 1.49.

The warp coverage of the top and bottom layers can also be of concern because of the density of bottom MD yarns. The closed area can be calculated by multiplying the number of yarns per centimeter by the diameter of each yarn in centimeters. For the specific example set forth above for the fabric 10, the top closed area is 30 percent and the bottom closed area is 75 percent.

Those skilled in the art will appreciate that, although the illustrated fabric in FIGS. 1, 2 and 3A–3B employs eight top MD yarns and sixteen bottom MD yarns (i.e., they are "twenty-four harness fabrics"), other numbers of top and bottom MD yarns may be employed in fabrics of the present invention. For example, fabrics employing six, ten or twelve top MD yarns and twelve, twenty or twenty-four bottom MD yarns, respectively, may also be suitable for fabrics of the present invention.

Figure 4A:
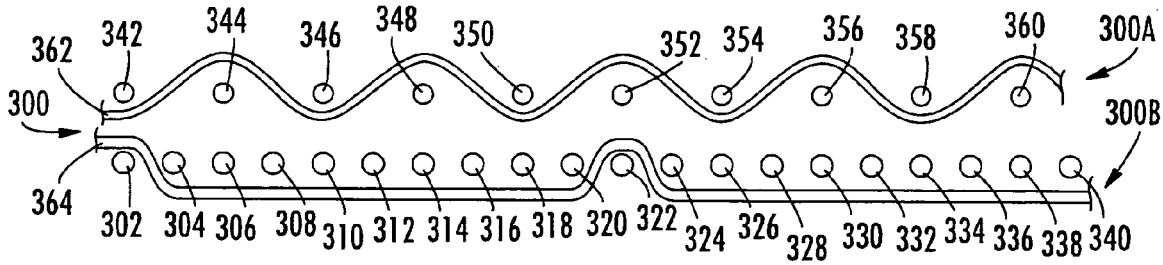
FIGS. 4A–B are section views of typical top and bottom CMD yarns (FIG. 4A) and typical stitching yarns (FIG. 4B) as they interweave with top and bottom MD yarns of a thirty harness papermaker's fabric according to other embodiments of the present invention.
Figure 4B:
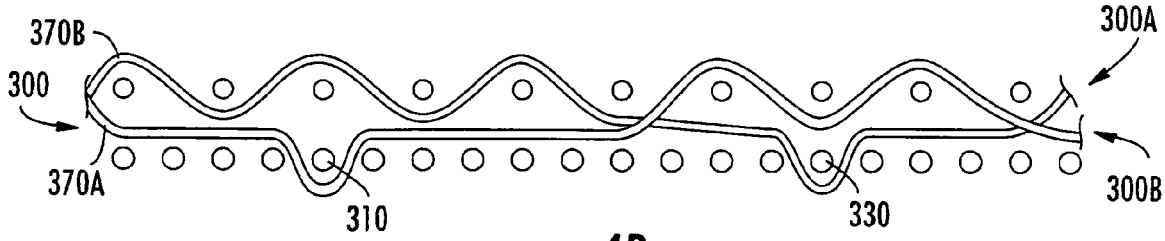

FIGS. 4A–4B illustrate a fabric 300 of an alternative embodiment of a thirty harness triple layer fabric. The fabric 300 includes twice as many bottom MD yarns as top MD yarns, i.e., twenty bottom MD yarns 302, 304, 306, 308, 310, 312, 314, 316, 318, 320, 322, 324, 326, 328, 330, 332, 334, 336, 338, and 340 and ten top MD yarns 342, 344, 346, 348, 350, 352, 354, 356, 358, and 360. As shown in FIG. 4A, the top MD yarns 342, 344, 346, 348, 350, 352, 354, 356, 358, and 360 interweave with an exemplary top CMD yarn 362 in an "over 1/under 1" pattern. The bottom MD yarns 302, 304, 306, 308, 310, 312, 314, 316, 318, 320, 322, 324, 326, 328, 330, 332, 334, 336, 338, and 340 interweave with an exemplary bottom cross machine direction yarn 364. As shown in FIG. 4B, the top MD yarns 342,344, 346, 348, 350, 352, 354, 356, 358, and 360 and the bottom MD yarns 302, 304, 306, 308, 310, 312, 314, 316, 318, 320, 322, 324, 326, 328, 330, 332, 334, 336, 338, and 340 are stitched together with exemplary stitching yarns 370A and 370B.

Although the fabric 300 is shown with respect to two exemplary views in FIGS. 4A–4B illustrating the top CMD yarn 362, bottom CMD yarn 364, and stitching yarn pair 370A, 370B, it should be understood that the fabric 300 includes additional top and bottom CMD yarns and stitching yarns in a repeat unit similar to that shown with respect to fabric 10 in FIGS. 1, 2 and 3A–3B. For example, the repeat unit of the fabric 300 can include ten top and bottom CMD yarns with corresponding pairs of stitching yarns between each top and bottom CMD yarn. Other CMD or MD yarn patterns and/or offset values are possible. For example, the CMD yarns can be offset from the nearest adjacent CMD yarn by two, four, or five MD yarns or any combination thereof such that different offset values can be used from one CMD yarn to the next. The MD yarns can also be offset from the nearest adjacent MD yarn by various numbers of CMD yarns.

As shown in FIG. 4A, as they interweave, each bottom CMD yarn, such bottom CMD yarn 364, follows an "over 1/under 9" weave pattern relative to the bottom MD yarns; i.e., it passes over bottom MD yarns 302 and 304, under bottom MD yarns 306, 308, 310, 312, 314, 316, 318, and 320, over bottom MD yarns 322 and 324, and under bottom MD yarns 326, 328, 330, 332, 334, 336, 338, and 340. Other weave patterns can be used, such as "over 2/under 8". Adjacent bottom CMD yarns (not shown) can be offset from one another by some number of bottom MD yarns. For example, ten top and bottom CMD yarns with corresponding pairs of stitching yarns between each top and bottom CMD yarn can be provided with each bottom CMD yarn forming an "over 1/under 9" pattern being offset from one another by three bottom MD yarns.

As shown in FIG. 4B, stitching yarns 370A, 370B interweave with the top MD yarns to form a fiber support portion that has an "over 1/under 1" pattern. The stitching yarns 370A, 370B also interweave with the bottom MD yarns to form a binding portion with binding knuckles. For example, in FIG. 4B, stitching yarn 370B passes over top MD yarn 342, under top MD yarn 344, over top MD yarn 346, under top MD yarn 348, and over top MD yarn 350, and intersects with stitching yarn 370A beneath transitional top MD yarn 352 and above bottom MD yarn 322. Beneath this fiber support portion of stitching yarn 370B, which forms the "over 1/under 1" pattern with top MD yarns 342, 344, 346, 348, and 350, stitching yarn 370A passes over bottom MD yarns 302, 304, 306, and 308, under bottom MD yarn 310, and over bottom MD yarns 312, 314, 316, 318, and 320 to form a binding knuckle at bottom MD yarn 310. The pattern for stitching yarns 370A and 370B is reversed for top MD yarns 354, 356, 358, and 360, where the fiber support portion of the stitching yarn 370A is located, and bottom MD yarns 324, 326, 328, 330, 332, 334,336, 338, and 340, where the binding portion of stitching yarn 370B is located. Adjacent stitching yarns in a repeat pattern (not shown) may be offset by some number of bottom MD yarns, such as three bottom MD yarns. Other offset values are possible; for example, adjacent stitching yarns may be offset from one another by two, four, or five bottom MD yarns as well as by different offset values from one yarn to the next.

Figure 5A:
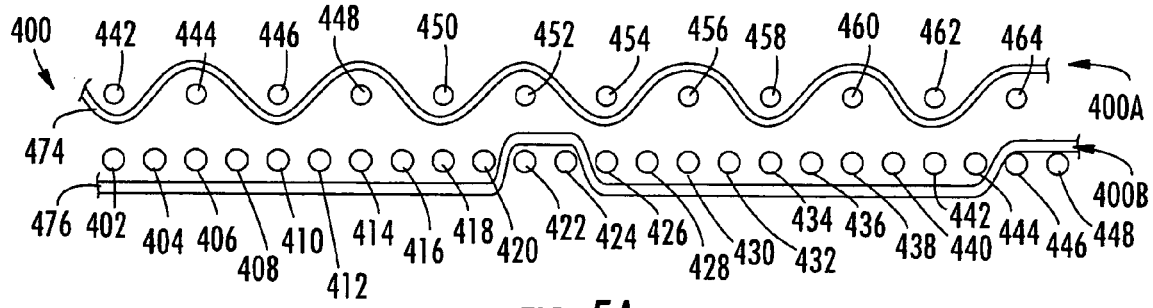
FIGS. 5A–5B are section views of typical top and bottom CMD yarns (FIG. 5A) and typical stitching yarns (FIG. 5B) as they interweave with top and bottom MD yarns of a thirty-six harness papermaker's fabric according to other embodiments of the present invention.
Figure 5B:
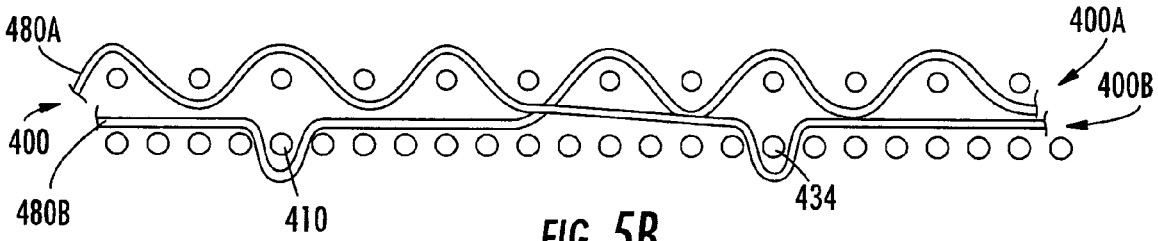

As a further example, FIGS. 5A–5B illustrate the MD yarns of a thirty-six harness fabric 400 having twice as many bottom MD yarns as top MD yarns. The fabric 400 includes twenty-four bottom MD yarns 402, 404, 406, 408, 410, 412, 414, 416, 418, 420,422, 424, 426, 428, 430, 432, 434, 436, 438, 440, 442, 444, 446, and 448 and twelve top MD yarns 450, 452, 454, 456, 458, 460, 462, 464, 466, 468, 470, and 472. As shown in FIG. 5A, the top MD yarns 450, 452, 454, 456, 458, 460, 462, 464, 466, 468, 470, and 472 interweave with an exemplary top CMD yarn 474 to form an "over 1/under 1" pattern. The bottom MD yarns 402, 404, 406, 408, 410, 412, 414, 416, 418, 420, 422, 424, 426, 428, 430, 432, 434, 436, 438, 440, 442, 444, 446, and 448 interweave with an exemplary bottom CMD yarn 476. As shown in FIG. 5B, the top MD yarns 450, 452, 454, 456, 458, 460, 462, 464, 466, 468, 470, and 472 and the bottom MD yarns 402, 404, 406, 408, 410, 412, 414, 416, 418, 420, 422, 424, 426, 428, 430, 432, 434, 436, 438, 440, 442, 444, 446, and 448 are stitched together with exemplary stitching yarns 480A and 480B.

Although the fabric 400 is shown with respect to two exemplary views in FIGS. 5A–5B illustrating the exemplary top CMD yarn 474, bottom CMD yarn 476, and stitching yarn pair 480A, 480B, it should be understood that the fabric 400 includes additional top and bottom CMD yarns and stitching yarns in a repeat unit similar to that shown with respect to fabric 10 in FIGS. 1, 2 and 3A–3B. For example, the repeat unit of the fabric 400 can include twelve top and bottom CMD yarns with corresponding pairs of stitching yarns between each top and bottom CMD yarn. Other CMD yarn patterns and/or offset values are possible.

As shown in FIG. 5A, as they interweave, each bottom CMD yarn, such bottom CMD yarn 476, follows an "over 2/under 10" weave pattern relative to the bottom MD yarns, e.g., over bottom MD yarns 402 and 404, under bottom MD yarns 406, 408, 410, 412, 414, 416, 418, and 420, over bottom MD yarns 422 and 424, and under bottom MD yarns 426, 428, 430, 432, 434, 436, 438, 440, 442, 444, 446, and 448. Other configurations are possible, such as an "over 1/under 11", or an "over 1/under 5/over 1/under 5" pattern. Adjacent bottom CMD yarns can be offset from one another by some number of bottom MD yarns. For example, twelve top and bottom CMD yarns with corresponding pairs of stitching yarns between each top and bottom CMD yarn can be provided in an "over 2/under 10" pattern with each bottom CMD yarn being offset from one another by three bottom MD yarns.

As shown in FIG. 5B, stitching yarns 480A, 480B interweave with the top MD yarns to form a fiber support portion that has an "over 1/under 1" pattern and interweave with the bottom MD yarns to form a binding portion with binding knuckles. The illustrated stitching yarn 480A passes over top MD yarn 450, under top MD yarn 452, over top MD yarn 454, under top MD yarn 456, over top MD yarn 458 and intersects with stitching yarn 480B beneath transitional top MD yarn 460 and above bottom MD yarn 422. Beneath this fiber support portion of stitching yarn 480A, which forms the "over 1/under 1" pattern with top MD yarns 450, 452, 454, 456, and 458, stitching yarn 480B passes over bottom MD yarns 402, 404, 406, and 408, under bottom MD yarn 410, and over bottom MD yarns 412, 414, 416, 418, 420, and 422 to form a binding knuckle at bottom MD yarn 410. The pattern for stitching yarns 480A and 480B is reversed for top MD yarns 462, 464, 466, 468, 470, and 472, where the fiber support portion of the stitching yarn 480B is located, and bottom MD yarns 422, 424, 426, 428, 430, 432, 434, 436, 438, 440, 442, 444, 446, and 448, where the binding portion of stitching yarn 480A is located. Adjacent stitching yarns in a repeat pattern (not shown) can be offset by some number of bottom MD yarns. For example, adjacent stitching yarn pairs can be offset by three bottom MD yarns.

Figure 5C:
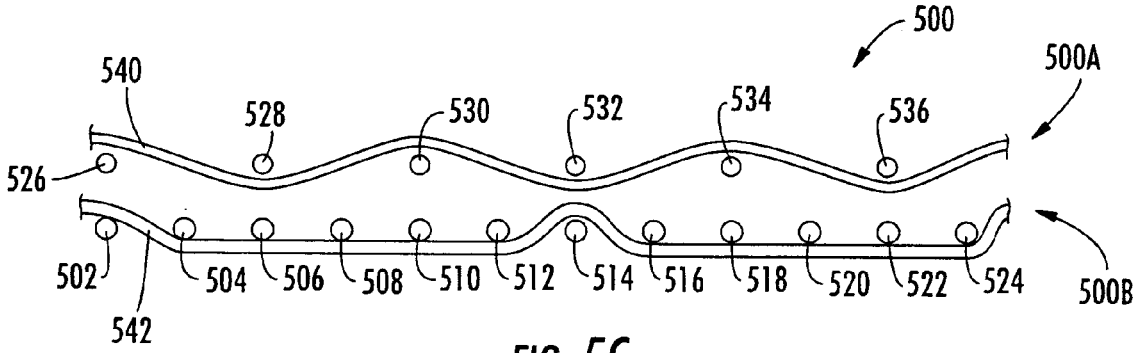
FIGS. 5C–5D are section views of typical top and bottom CMD yarns (FIG. 5C) and typical stitching yarns (FIG. 5D) as they interweave with top and bottom MD yarns of an eighteen harness papermaker's fabric according to still other embodiments of the present invention.
Figure 5D:
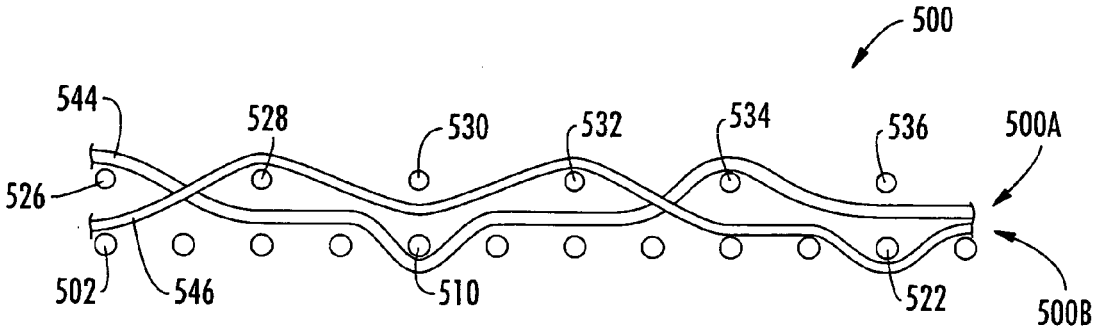

As another example, FIGS. 5C–5D illustrate the MD yarns of an eighteen harness fabric 450 having twice as many bottom MD yarns as top MD yarns. The fabric 500 includes twelve bottom MD yarns 502, 504, 506, 508, 510, 512, 514, 516, 518, 520, 522, and 524 and six top MD yarns 526, 528, 530, 532, 534, and 536. As shown in FIG. 5C, the top MD yarns 526, 528, 530, 532, 534, and 536 interweave with an exemplary top CMD yarn 540 to form an "over 1/under 1" pattern. The bottom MD yarns 502, 504, 506, 508, 510, 512, 514, 516, 518, 520, 522, and 524 interweave with an exemplary bottom CMD yarn 542. As shown in FIG. 5D, the top MD yarns 526, 528, 530, 532, 534, and 536 and the bottom MD yarns 502, 504, 506, 508, 510, 512, 514, 516, 518, 520, 522, and 524 are stitched together with exemplary stitching yarns 544 and 546.

It should be understood that the fabric 500 includes additional top and bottom CMD yarns and stitching yarns in a repeat unit similar to that shown with respect to fabric 10 in FIGS. 1, 2 and 3A–3B. For example, the repeat unit of the fabric 500 can include twelve top and bottom CMD yarns with corresponding pairs of stitching yarns between each top and bottom CMD yarn. Other CMD yarn patterns are possible.

As shown in FIG. 5C, as they interweave, each bottom CMD yarn, such bottom CMD yarn 542, follows an "over 1/under 5" weave pattern relative to the bottom MD yarns, e.g., over bottom MD yarn 502, under bottom MD yarns 504, 506, 510, and 512, over bottom MD yarn 514, and under bottom MD yarns 516, 518, 520, 522, and 524. Other configurations are possible, such as an "over 2/under 4", or an "over 3/under 3" pattern. Adjacent bottom CMD yarns can be offset from one another by some number of bottom MD yarns. For example, twelve top and bottom CMD yarns with corresponding pairs of stitching yarns between each top and bottom CMD yarn can be provided in an "over 1/under 5" pattern with each bottom CMD yarn being offset from one another by two, three or four bottom MD yarns or some combination thereof.

As shown in FIG. 5D, stitching yarns 544, 546 interweave with the top MD yarns to form a fiber support portion that has an "over 1/under 1" pattern and interweave with the bottom MD yarns to form a binding portion with binding knuckles under bottom MD yarns 510 and 522. Adjacent stitching yarns in a repeat pattern (not shown) can be offset by some number of bottom MD yarns. For example, adjacent stitching yarn pairs can be offset by two, three, or four bottom MD yarns or some combination thereof.

As would be appreciated by those of skill in the art, various top fabric layer configurations and weave patterns may be substituted for the top layers and bottom layers discussed above. For example, in fabrics 10, 300, 400, and 500 when either of the bottom layers 200, 300B, 400B, and 500B are joined with the respective top layers 100, 300A, 400A, and 500A each of the bottom CMD yarns is positioned substantially directly below a corresponding top CMD yarn. There is no bottom CMD yarn positioned substantially directly below the stitching yarn, thereby providing a space in which the stitching yarns can stitch below a bottom CMD yarn. Of course, those skilled in this art will appreciate that the fabric may have differing numbers of top and bottom CMD yarns in a repeat unit; for example, there may be 1.5, two or three times as many top CMD yarns as bottom CMD yarns, or there may be a CMD yarn below each pair of stitching yarns. Also, the top layers 100, 300A, 400A, and 500A may vary from plain weave patterns illustrated herein; for example, the pattern of the top layer may be satin, twill, broken twill, or the like.

The illustrated fabrics employ a particular configuration of stitching yarns that are woven as "reversed picks". The "reversed picks" configuration is described in detail in U.S. Pat. Nos. 5,967,195 and 6,145,550 to Ward. To summarize for embodiments of the present invention, the presence of reversed picks in a double-pick-stitched triple layer fabric can be established by locating the transitional top MD yarns; these are the top MD yarns under which stitching yarns pass when transitioning from the top layer to the bottom layer or vice versa. Once the transitional top MD yarns for each stitching pair are located, the most predominant diagonal formed by the transitional top MD yarns is identified, i.e., the most predominant diagonal being the diagonal having the minimum number of steps between transitional top MD yarns. If the fiber support portions of successive stitch yarn pairs on one side of this diagonal are closer to each other in some cases and further apart in others, then the fabric can be said to have at least some "reversed picks" in the stitching yarn configuration. Although in some embodiments, all of the stitching yarn pairs may follow this pattern, it is also possible that only some portion of the stitching yarns may follow this pattern, i.e., 50, 40, 33, or 25% of the stitching yarn pairs can be "reversed".

Those skilled in this art will appreciate that, although the above illustrated fabrics employ a particular configuration of "reversed pick" stitching yarn pairs, other stitching yarn configurations can be used, including other percentages of "reversed pick" stitching yarn pairs, "pseudo-stitching" yarn pairs, "self-stitched" patterns or single stitching yarn configurations.

In a pseudo-stitching yarn configuration, only one of the yarns in a stitching yarn pair forms a knuckle with the bottom MD yarns. Referring to FIG. 2, the stitching yarns pair 140A and 140B could be modified to be pseudo-stitching yarns if only one of the stitching yarns 140A and 140B stitched underneath bottom MD yarn 216 or 232. For example, in a pseudo-stitching yarn configuration, if stitching yarn 140B passes underneath bottom MD yarn 232, then stitching yarn 140A would be modified from FIG. 2 to pass above bottom MD yarn 216. A specific example of "pseudo-stitching" yarn pairs is shown in FIGS. 8, 9A–9P, and 11A–11P, discussed below. In addition, or alternatively, the stitching yarns may not interlace with the top MD yarns as frequently as shown. The stitching yarns may also form more or fewer binding knuckles with the bottom MD yarns than shown.

In a self-stitched pattern, the top layer and the bottom layer of the fabric are stitched together by selected ones of the top and/or bottom CMD yarns. Examples of self-stitched fabrics are illustrated in FIGS. 12–13, 14A–14P, 15, 16A–16B and 17A–17B and discussed below.

Although the above illustrated embodiments employ plain weave pattern top layers, the fabrics of the present invention may also employ other top layer weave patterns; for example, satins, broken twills, and the like may also be employed. The stitching yarns may comprise an integral portion of the top surface weave or may not.

Figure 6:
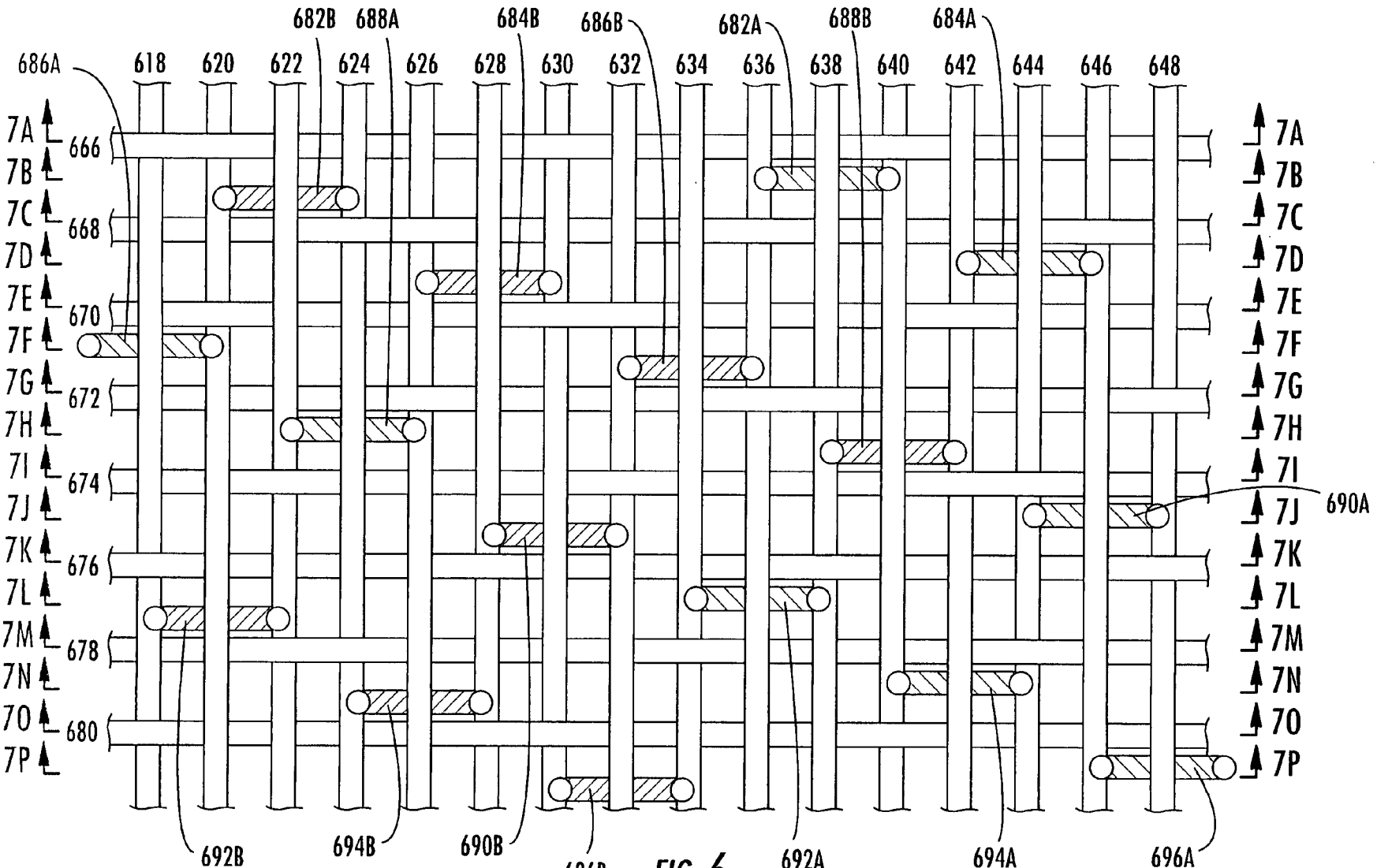
FIG. 6 is a top view of the bottom layer of a twenty-four harness triple layer papermaker's forming fabric according to further embodiments of the present invention with the top layer removed.

Various patterns of bottom layers may also be used. For example, an exemplary bottom layer 600 in FIG. 6 has bottom CMD yarns that interweave with bottom MD yarns an "over 2/under 4/over 1/under 4/over 1/under 4" pattern that is offset from each adjacent bottom CMD yarns by three bottom MD yarns. Specifically, each repeat pattern of the bottom layer has sixteen bottom MD yarns 618, 620, 622, 624, 626, 628, 630, 632, 634, 636, 638, 640, 642, 644, 646, and 648 that interweave with eight bottom CMD yarns 666, 668, 670, 672, 674, 676, 678, and 680 in an "over 2/under 4/over 1/under 4/over 1/under 4" pattern. For example, bottom CMD yarn 666 passes over bottom MD yarns 618 and 620, under bottom MD yarns 622, 624, 626, and 628, over bottom MD yarn 630, under bottom MD yarns 632, 634, 636, and 638, over bottom MD yarn 640, and under 642, 644, 646, and 648. Bottom CMD yarn 668 is adjacent bottom CMD yarn 666 and interweaves in the same pattern offset by three bottom MD yarns. That is, bottom CMD yarn 668 passes over bottom MD yarns 624 and 626, under bottom MD yarns 628, 630, 632, and 634 and so forth.

Figure 7A:
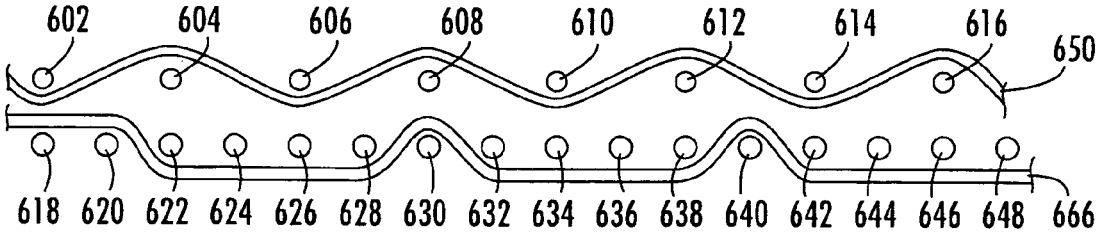
FIGS. 7A–7P are section views taken along lines 7A—7A to 7P—7P, respectively, of FIG. 6 of the fabric thereof.
Figure 7B:
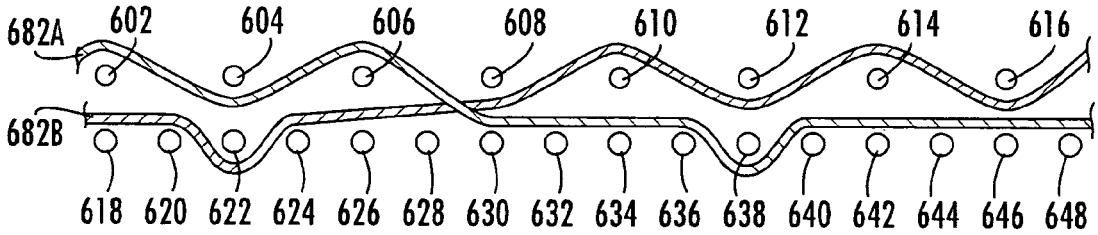
Figure 7C:
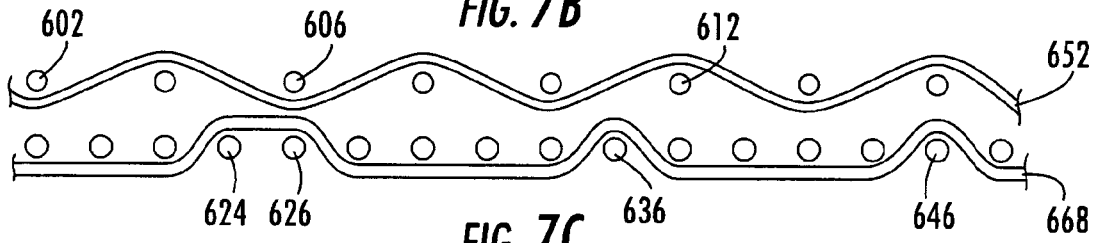
Figure 7D:
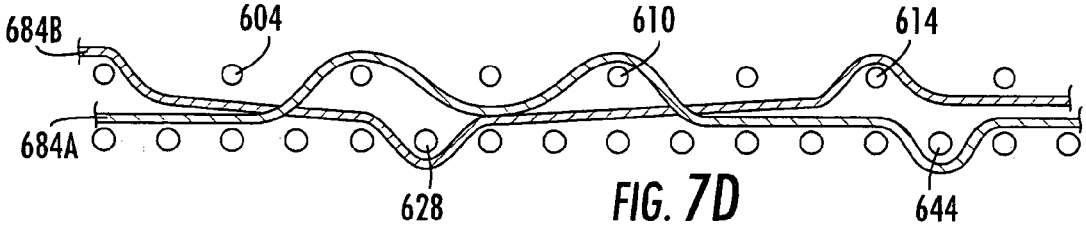
Figure 7E:
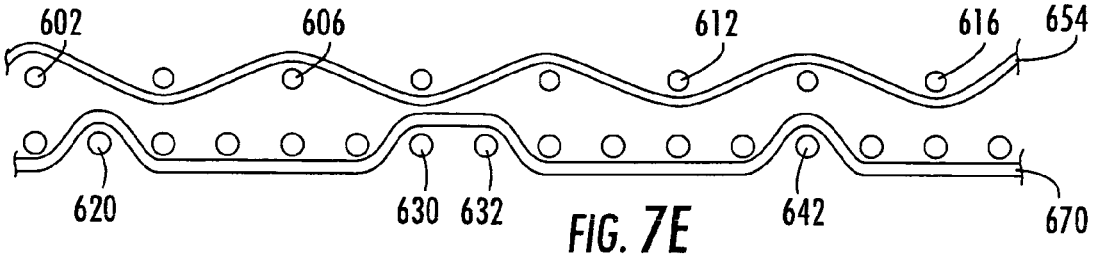
Figure 7F:
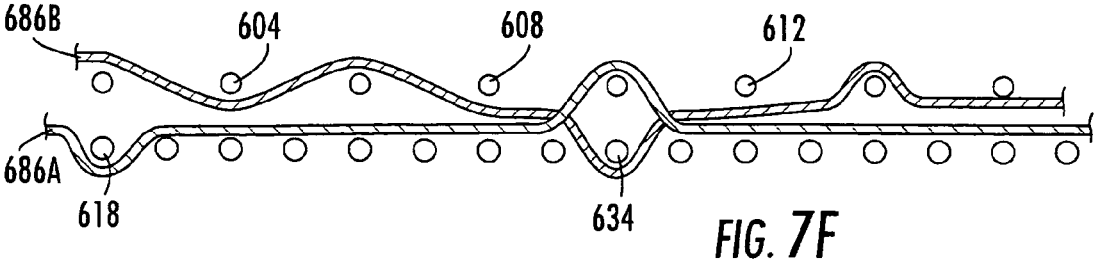
Figure 7G:
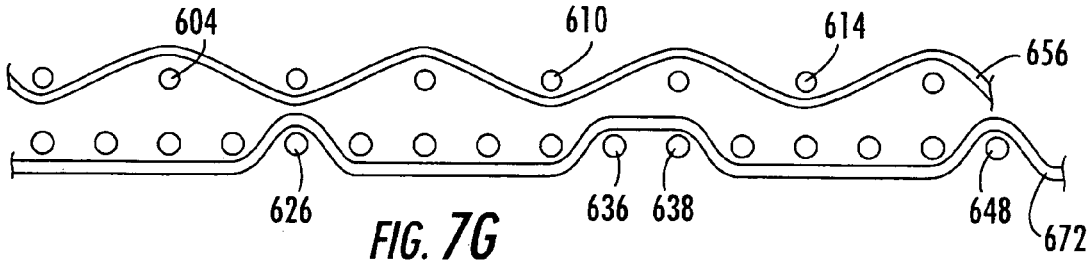
Figure 7H:
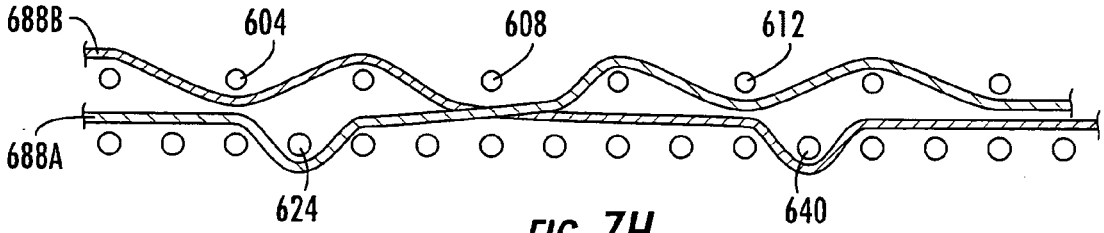
Figure 7I:
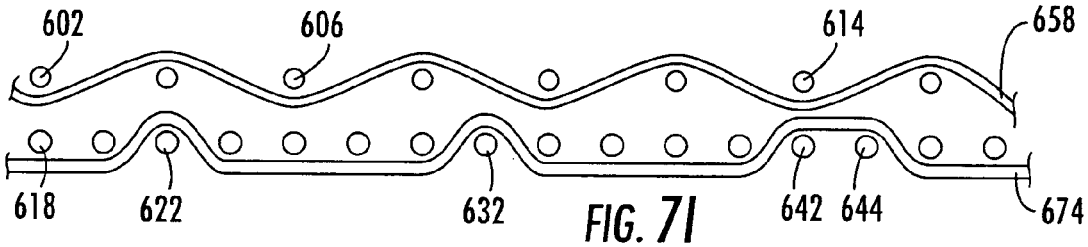
Figure 7J:
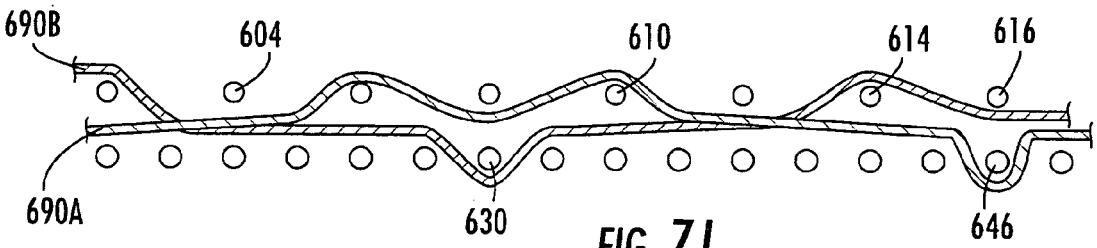
Figure 7K:
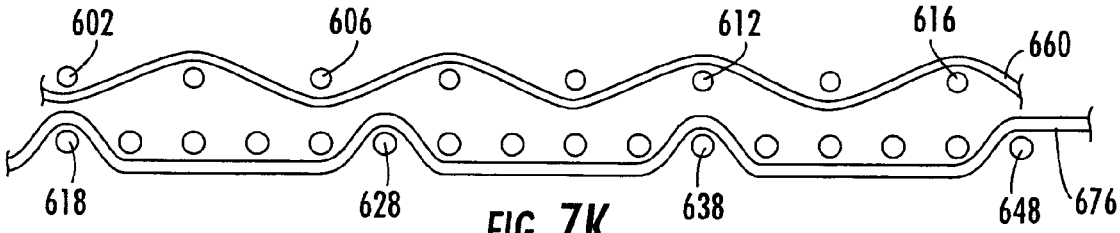
Figure 7L:
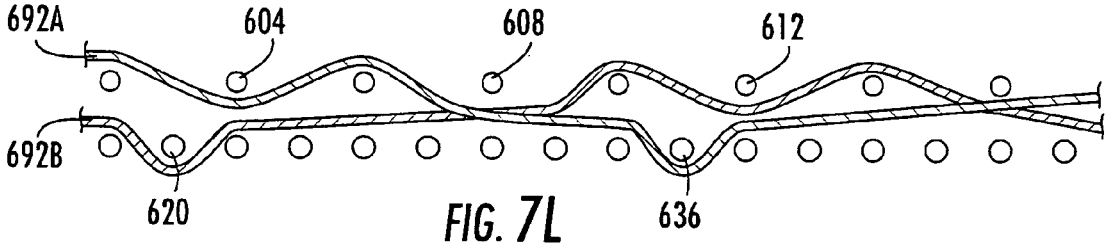
Figure 7M:
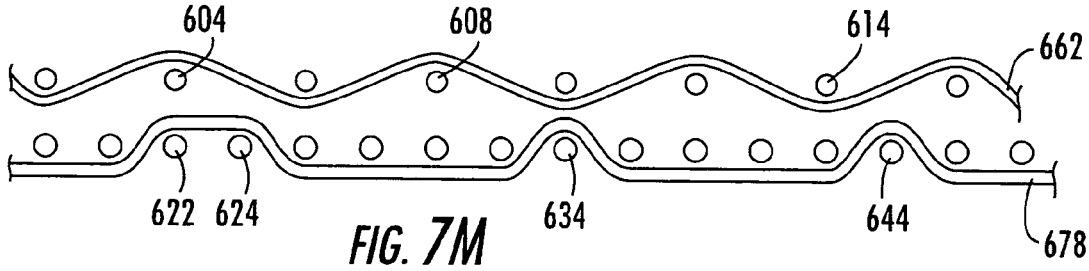
Figure 7N:
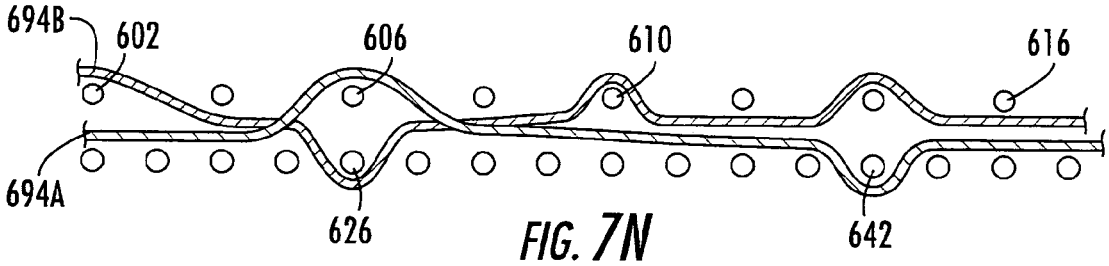
Figure 70:
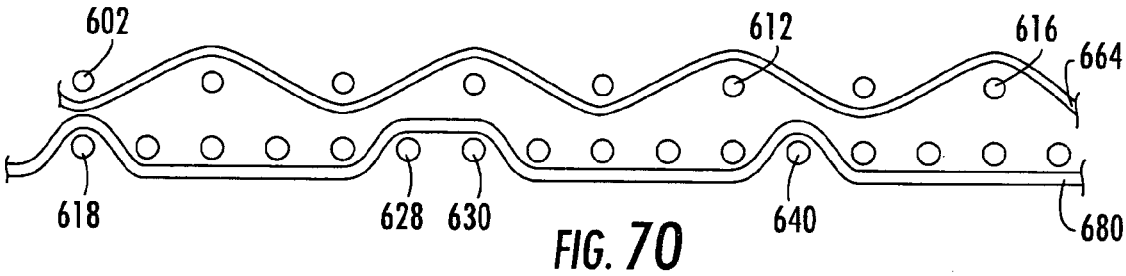
Figure 7P:
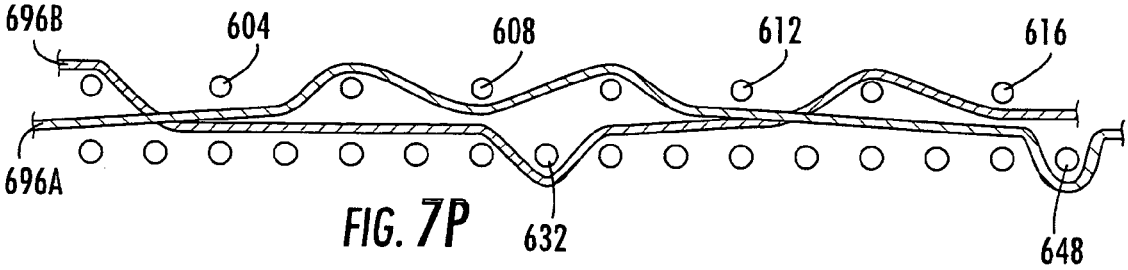

As further shown in FIGS. 7A–7P, the fabric 600 includes eight top MD yarns 602, 604, 606, 608, 610, 612, 614, and 616. Thus, the fabric 600 has twice as many bottom MD yarns as top MD yarns. The top MD yarns 602, 604, 606, 608, 610, 612, 614, and 616 interweave with top CMD yarns 650, 652, 654, 656, 658, 660, 662 and 664. The top and bottom layer of the fabric 600 are stitched together with stitching yarn pairs 682A, 682B, 684A, 684B, 686A, 686B, 688A, 688B, 690A, 690B, 692A, 692B, 694A, 694B, 696A, and 696B. The stitching yarns and the top CMD yarns together form a plain weave top layer with the top MD yarns.

Figure 8:
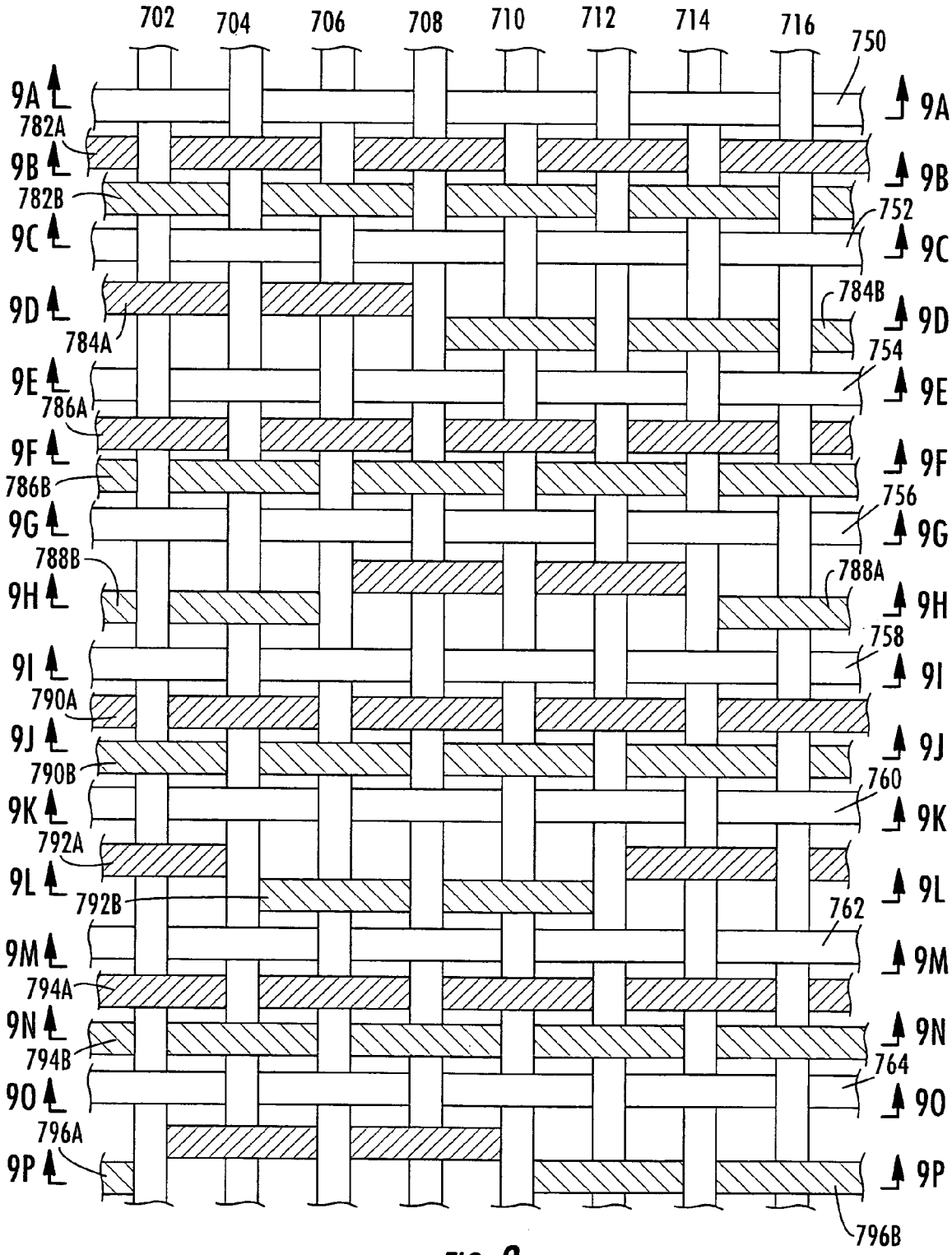
FIG. 8 is a top view of the top layer of a twenty-four harness triple layer papermaker's fabric according to still further embodiments of the present invention.
Figure 9A:
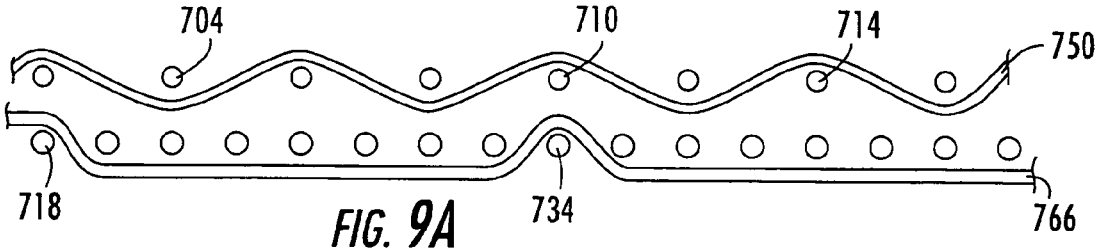
FIGS. 9A–9P are section views taken along lines 9A—9A to 9P—9P, respectively, of FIG. 8 of the fabric thereof.
Figure 9B:
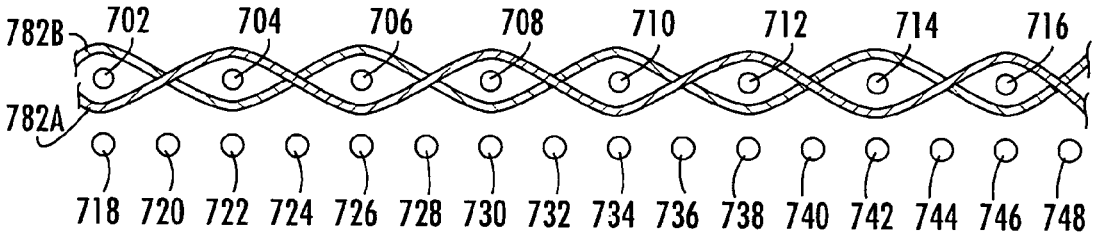
Figure 9C:
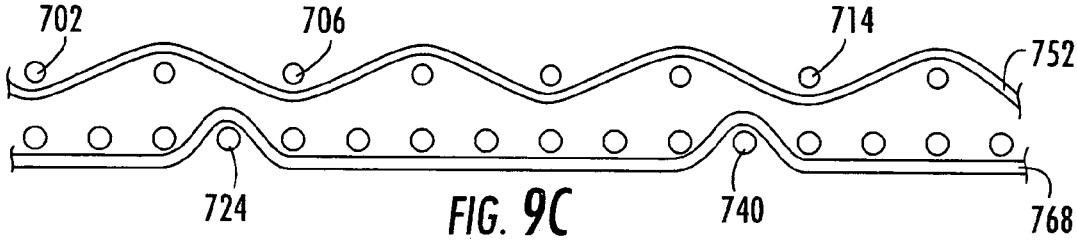
Figure 9D:
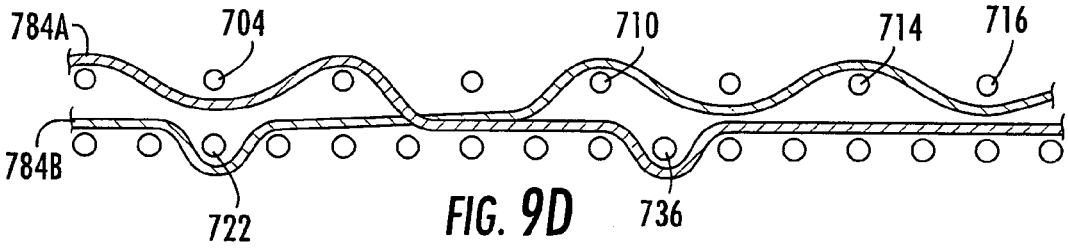
Figure 9E:
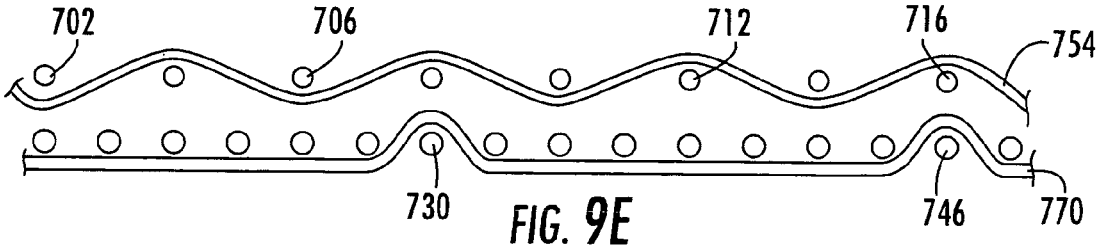
Figure 9F:
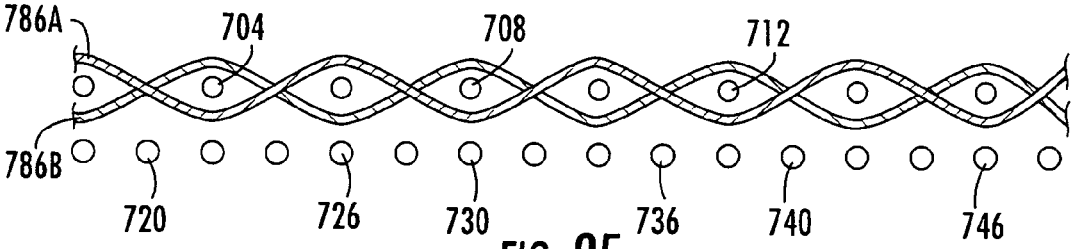
Figure 9G:
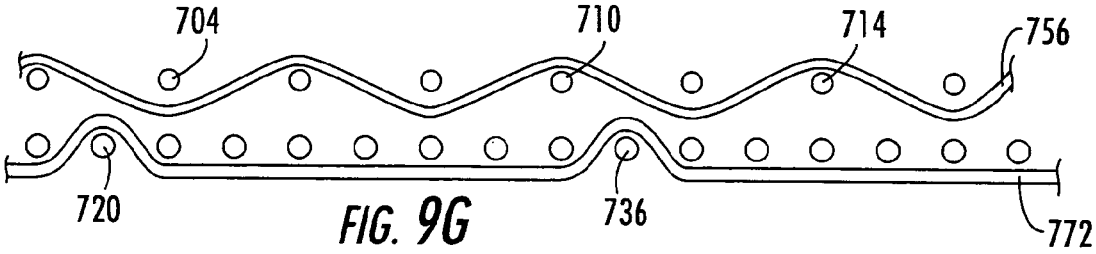
Figure 9H:
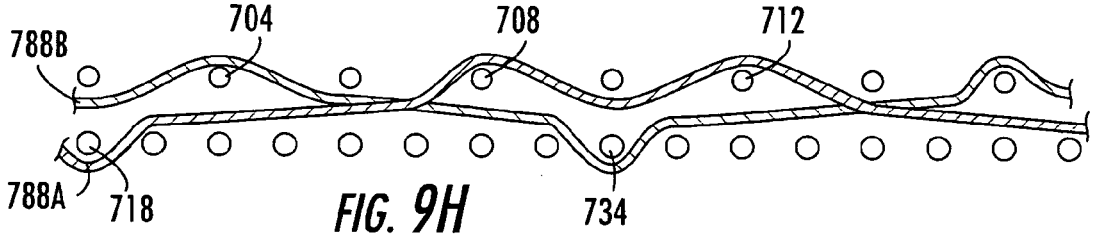
Figure 9I:
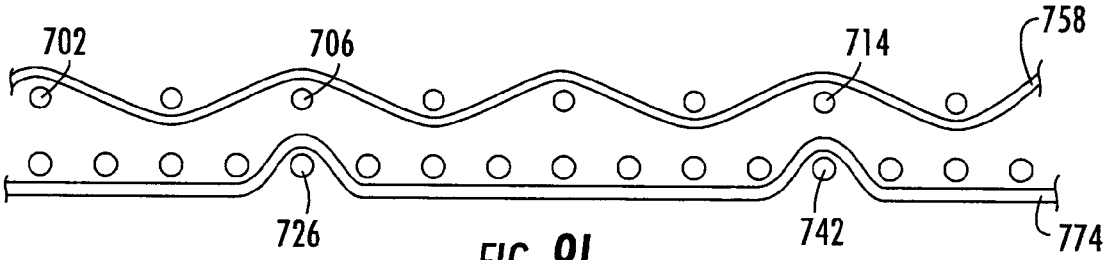
Figure 9J:
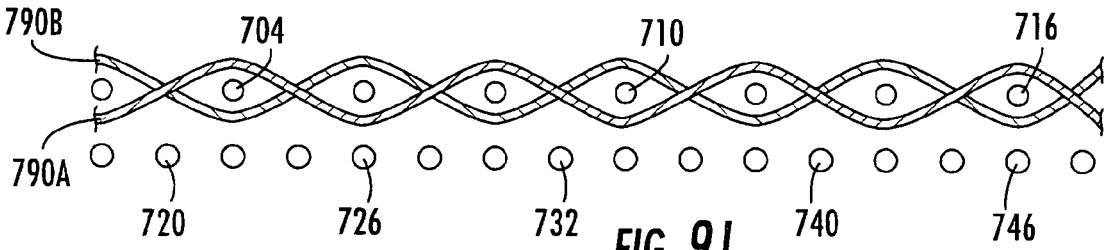
Figure 9K:
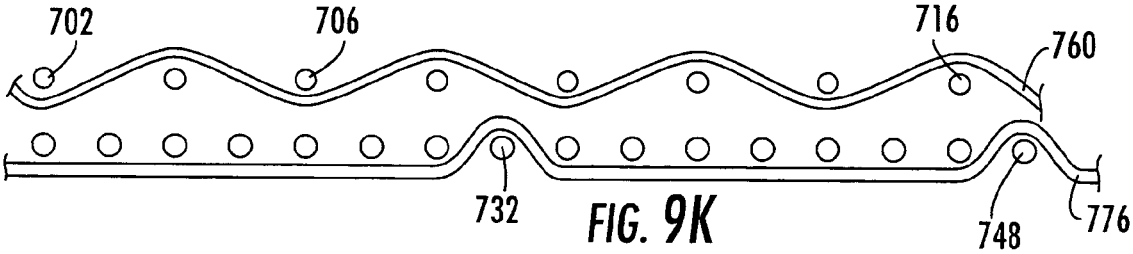
Figure 9L:
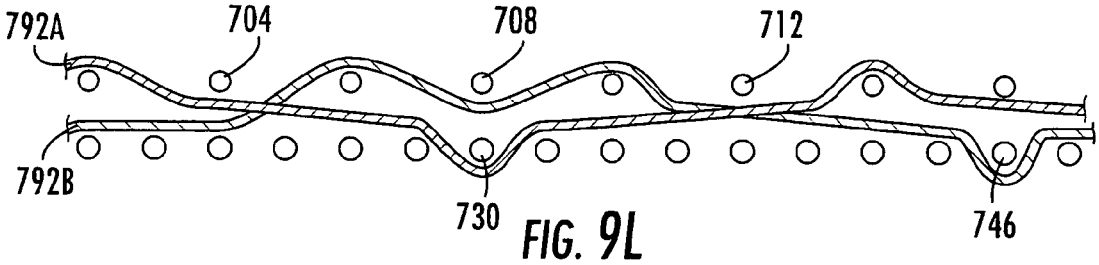
Figure 9M:
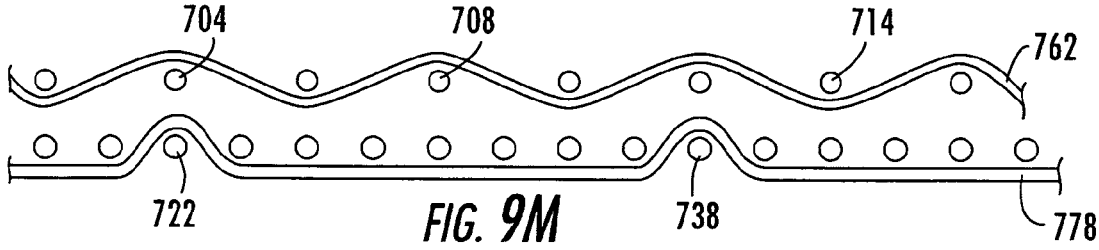
Figure 9N:
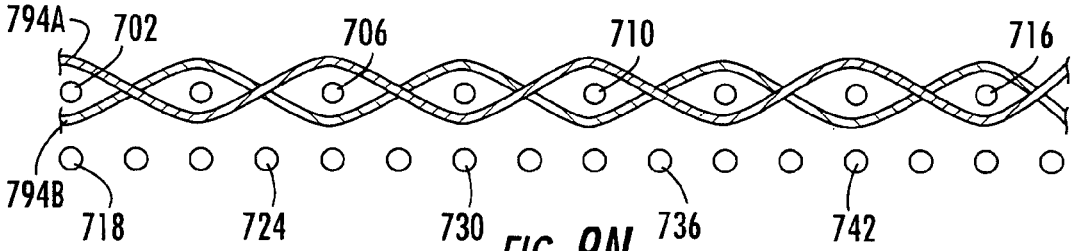
Figure 90:
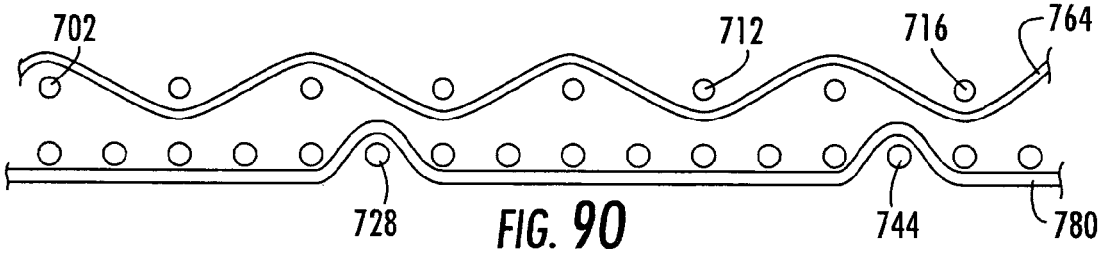
Figure 9P:
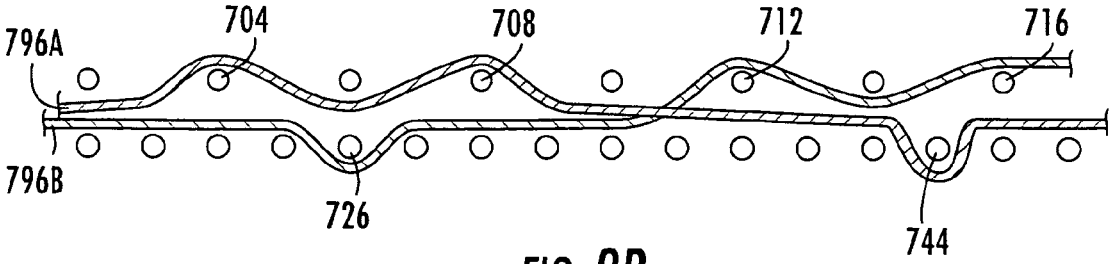

Alternative stitching patterns, in which some of the "stitching yarns" (or "pseudo-stitching yarns" do not form a stitching knuckle with the bottom layer, are illustrated in FIGS. 8 and 9A–9P. As shown, the fabric 700 includes a top layer having eight top MD yarns 702, 704, 706, 708, 710, 712, 714, and 716 interwoven with eight top CMD yarns 750, 752, 754, 756, 758, 760, 762 and 764. The fabric also has a bottom layer including sixteen bottom MD yarns 718, 720, 722, 724, 726, 728, 730, 732, 734, 736, 738, 740, 742, 744, 746, and 748 interwoven with eight bottom CMD yarns 766, 768, 770, 772, 774, 776, 778, and 780. The bottom MD and CMD yarns are interwoven in an "over 1/under 7" pattern similar to the bottom layer 200 shown in FIGS. 2 and 3A–3B.

The top layer and the bottom layer of the fabric 700 are stitched together by stitching yarn pairs 784A, 784B, 788A, 788B, 792A, 792B, 796A, and 796B. The stitching yarn pairs 784A, 784B, 788A, 788B, 792A, 792B, 796A, and 796B each include fiber support portions that form a plain weave pattern with the top MD yarns 702, 704, 706, 708, 710, 712, 714, and 716 and the top CMD yarns 750, 752, 754, 756, 758, 760, 762 and 764. The stitching yarn pairs 784A, 784B, 788A, 788B, 792A, 792B 796A, and 796B also include a binding portion that interweaves with a bottom MD yarn to form a binding knuckle. Thus, stitching yarn pairs 784A, 784B, 788A, 788B, 792A, 792B 796A, and 796B form a pattern similar to the stitching yarn pairs shown in fabrics 10 and 600 shown in FIGS. 2, 3A–3B, 6 and 7A–7P.

However, the fabric 700 also includes additional pseudo "stitching yarns" 782A, 782B, 786A, 786B, 790A, 790B, 794A, and 794B. The pseudo-stitching yarns form a plain weave pattern with the top CMD yarns and do not include a binding knuckle. The pseudo stitching yarns 782A, 782B, 786A, 786B, 790A, 790B, 794A, and 794B can be positioned between alternating top CMD yarns and can also be the same diameter as the true stitching yarn pairs 784A, 784B, 788A, 788B, 792A, 792B, 796A, and 796B. As an example of the plain weave pattern, pseudo-stitching yarn 782A passes under top CMD yarn 702, over top CMD yarn 704 and so forth until it passes over top CMD yarn 716. Adjacent pseudo-stitching yarn 782B passes over top CMD yarn 702, under top CMD yarn 704 and so forth until it passes under top CMD yarn 716. The pseudo-stitching yarns 782A, 782B, 786A, 786B, 790A, 790B, 794A, and 794B may be described as top CMD yarns that have approximately the same diameter as a stitching yarn.

In this configuration additional yarns can be provided in the top fabric layer in the CMD direction. Accordingly, a finer weave pattern may be provided on the top layer.

Moreover, this configuration maintains twice the number of bottom MD yarns as top MD yarns, which may provide increased drainage through the fabric.

Figure 10A:
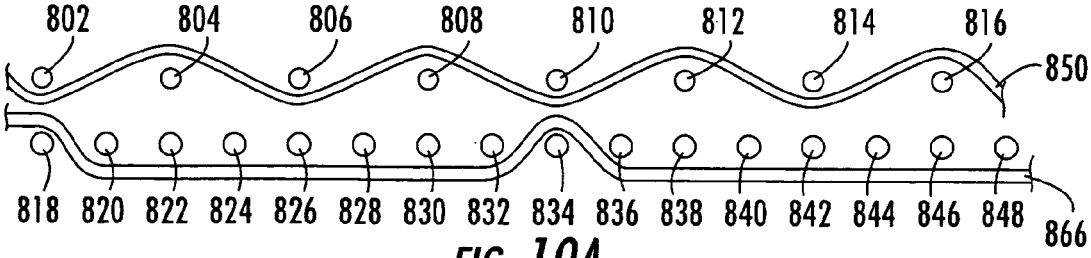
FIGS. 10A–10P are section views of a twenty-four harness triple layer papermaker's forming fabric according to further embodiments of the present invention.
Figure 10B:
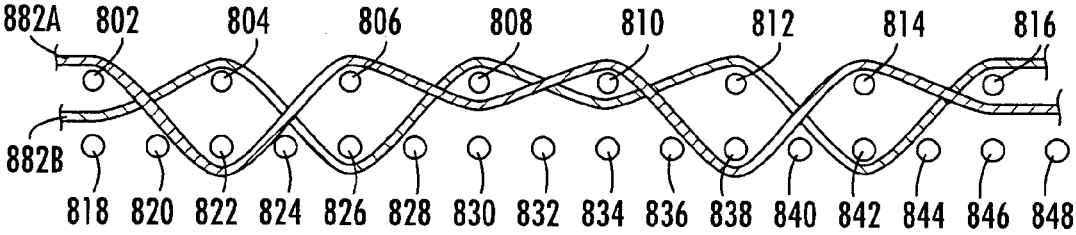
Figure 10C:
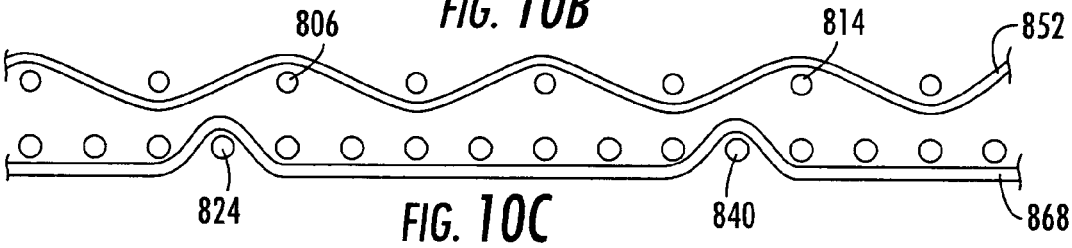
Figure 10D:
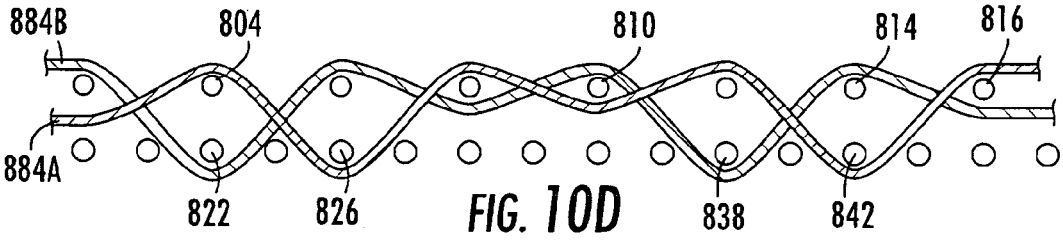
Figure 10E:
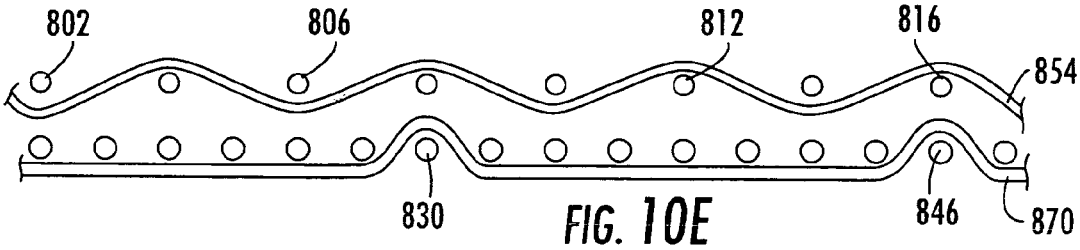
Figure 10F:
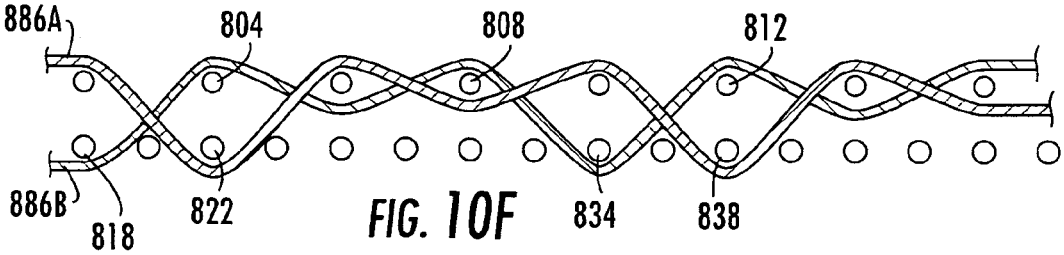
Figure 10G:
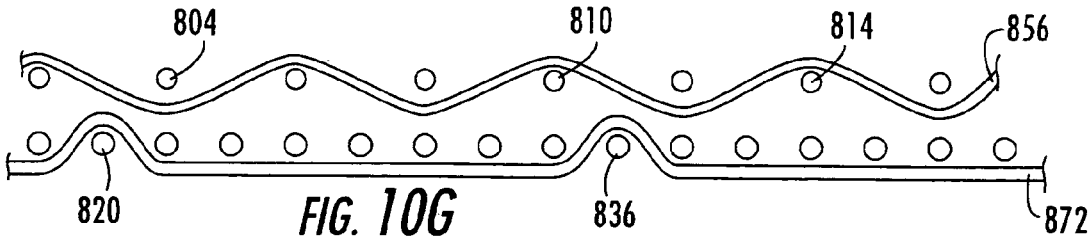
Figure 10H:
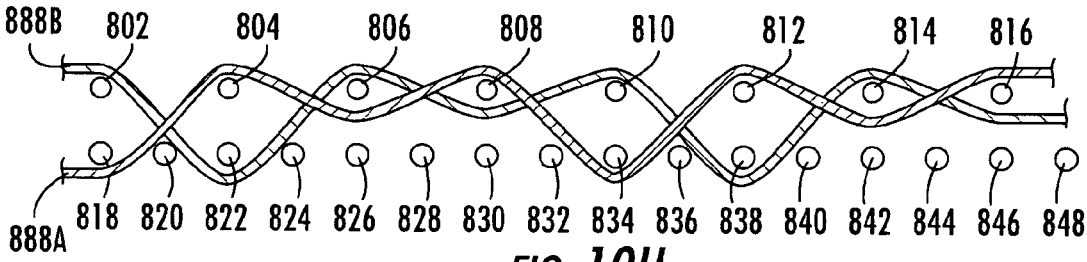
Figure 10I:
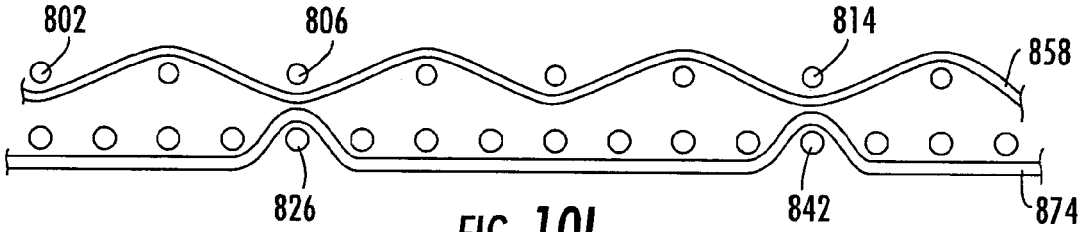
Figure 10J:
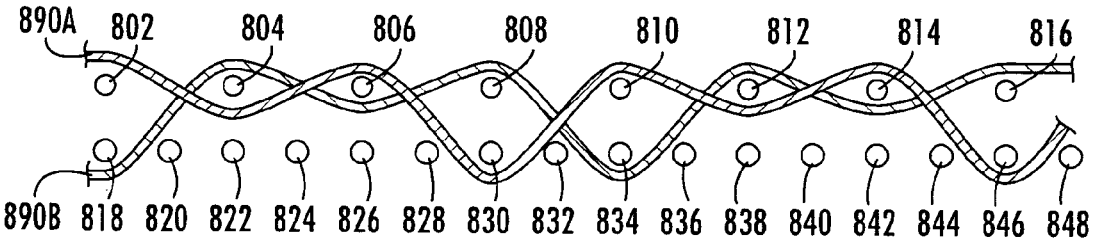
Figure 10K:
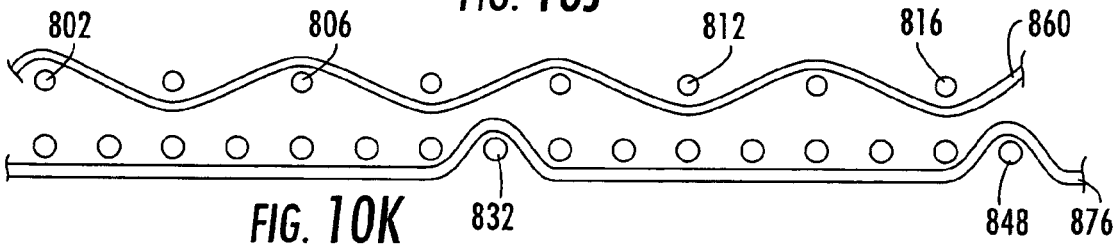
Figure 10L:
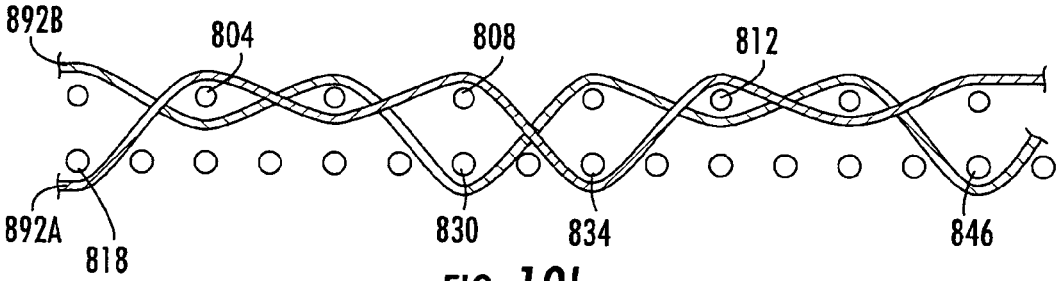
Figure 10M:
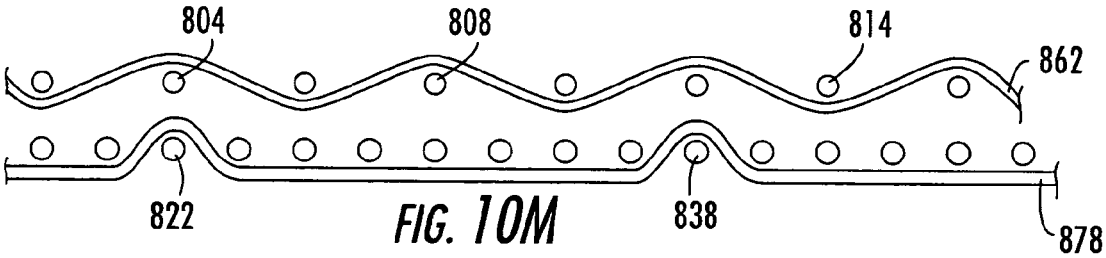
Figure 10N:
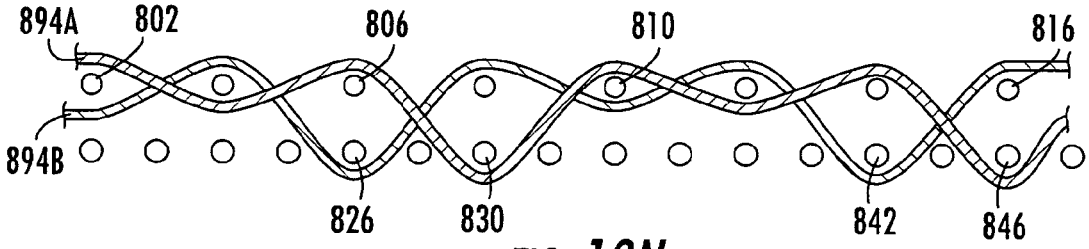
Figure 10O:
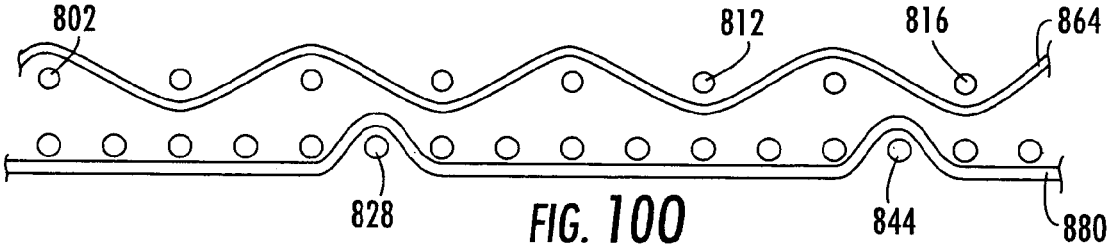
Figure 10P:
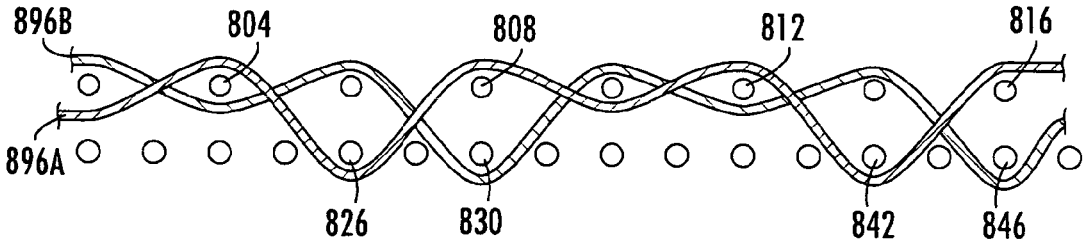

Further embodiments of a twenty-four harness triple layer fabric having an alternative stitching arrangement are shown in FIGS. 10A–10P. The fabric 800 includes sixteen bottom MD yarns 818, 820, 822, 824, 826, 828, 830, 832, 834, 836, 838, 840, 842, 844, 846, and 848 and eight top bottom MD yarns 802, 804, 806, 808, 810, 812, 814, and 816, i.e., twice as many bottom MD yarns as top MD yarns. The bottom MD yarns 818, 820, 822, 824, 826, 828, 830, 832, 834, 836, 838, 840, 842, 844, 846, and 848 are interwoven with bottom CMD yarns 866, 868, 870, 872, 874, 876, 878, and 880 so that each bottom CMD yarn passes over one bottom MD yarn, under seven bottom MD yarns, over one bottom MD yarn and under seven bottom MD yarns. Each bottom CMD yarn is offset from its nearest bottom CMD yarn neighbor by three bottom MD yarns. For example, bottom CMD yarn 866 passes over bottom MD yarns 818 and 834 (and under the remaining bottom MD yarns) such that bottom MD yarns 818, 834 form bottom MD yarn knuckles. Bottom CMD yarn 868, which is the nearest adjacent bottom CMD yarn to bottom CMD yarn 866, passes over bottom MD yarns 824 and 840 (and under the remaining bottom MD yarns).

The top and bottom layers of the fabric 800 are stitched together by stitching yarn pairs 882A, 882B, 884A, 884B, 886A, 886B, 888A, 888B, 890A, 890B, 892A, 892B, 894A, 894B, 896A, and 896B. As shown in FIGS. 10A–10P, each stitching yarn pair has two fiber support portions that each interweave with three top MD yarns in an "over 1/under 1/over 1" pattern followed by a single binding stitch with a bottom MD yarn. In this configuration, the fiber support portions of each stitching yarn interweave with six top MD yarns. For example, with reference to FIG. 10J, stitching yarn 890A passes over top MD yarn 802, under top MD yarn 804, over top MD yarn 806, and forms a binding knuckle by passing under bottom MD yarn 830. Stitching yarn 890A then forms a second fiber support portion by passing over top MD yarn 810, under top MD yarn 812, over top MD yarn 814, and forms a second binding knuckle by passing under bottom MD yarn 846. The corresponding stitching yarn 890B in the stitching yarn pair is offset from stitching yarn 890A by two bottom MD yarns. That is, stitching yarn 890A forms a one fiber support portion with top MD yarns 804, 806, and 808, a bottom binding knuckle under bottom MD yarn 834, a second fiber support portion with top MD yarn 812, 814, and 816, and a second binding knuckle under bottom MD yarn 818.

One of the nearest neighboring stitching yarn pairs of a selected stitching yarn pair is offset by two bottom MD yarns. The stitching yarn pair on the other side of the selected stitching yarn pair repeats the pattern of the selected stitching yarn pair. As illustrated in FIGS. 10A–10P, the stitching yarns designated "A" are stitched in the weaving process before the stitching yarns designated "B", e.g., stitching yarn 882A is closer to top cross machine direction yarn 850 and bottom cross machine direction yarn 866 than stitching yarn 882B. The stitching yarn pairs that repeat the pattern of an adjacent stitching yarn pair have the "A" and "B" designations reversed.

As shown in FIG. 10H, stitching yarn pair 888A, 888B, which is one of the next nearest stitching yarn pair to stitching yarn pair 890A, 890B, is offset from the pattern of stitching yarn pair 890A, 890B, discussed above, by two bottom MD yarns. Specifically, stitching yarn 888A forms binding knuckles with bottom MD yarns 818 and 834 and forms one fiber support portion with top MD yarns 804, 806, and 808 and another fiber support portion with top MD yarns 812, 814, and 816. Stitching yarn 888B forms binding knuckles with bottom MD yarns 822 and 838 and forms a fiber support portion with top MD yarns 806, 808, and 810 and a second fiber support portion with top MD yarns 814, 816 and 802. As shown in FIG. 10L, the other next nearest stitching yarn pair 892A, 892B to stitching yarn pair 890A, 890B forms a similar pattern as stitching yarn pair 890A, 890B except that the stitching yarns designated "A" and "B" are reversed, i.e., stitching yarn 892A forms the same pattern as stitching yarn 890B and stitching yarn 890A forms the same pattern as stitching yarn 890B.

Figure 11A:
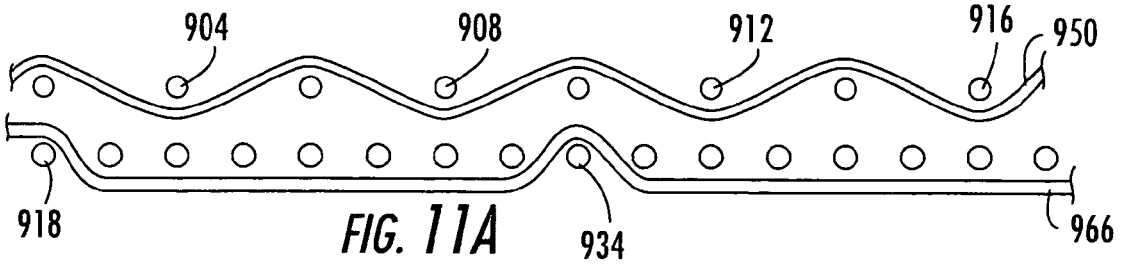
FIGS. 11A–11P are section views of a twenty-four harness triple layer papermaker's forming fabric according to further embodiments of the present invention.
Figure 11B:
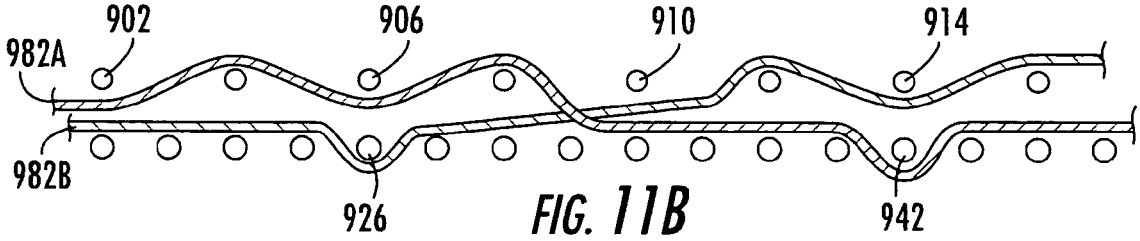
Figure 11C:
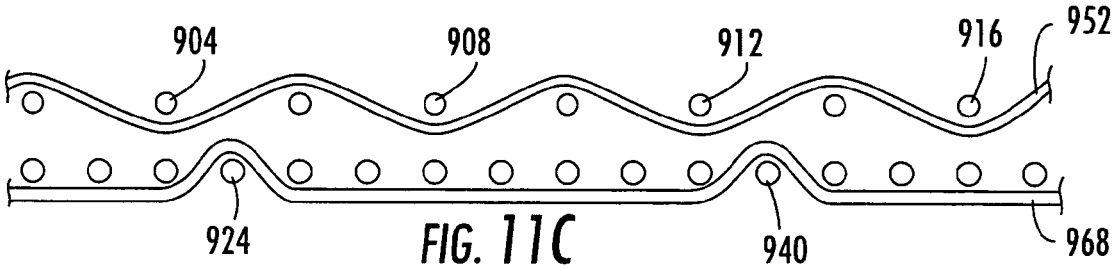
Figure 11D:
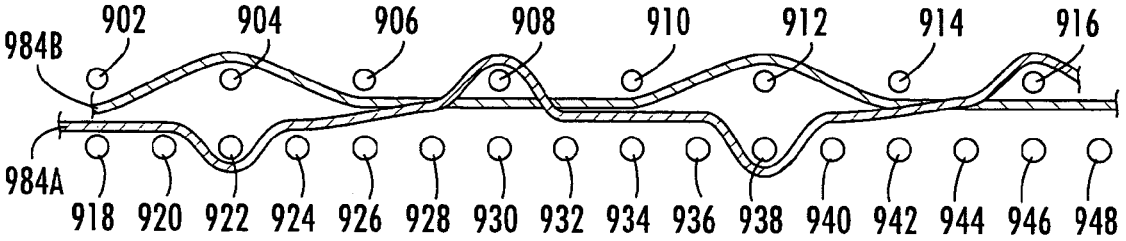
Figure 11E:
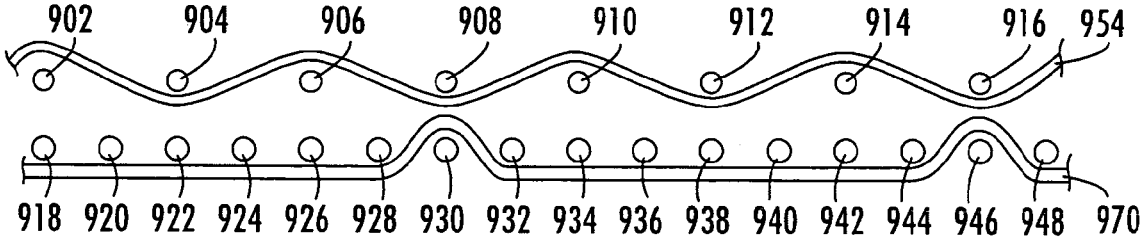
Figure 11F:
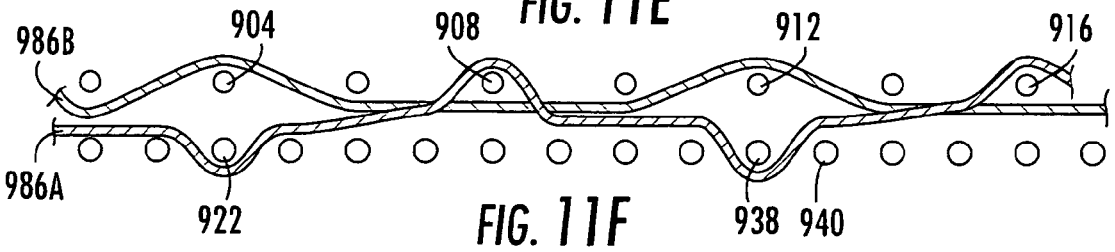
Figure 11G:
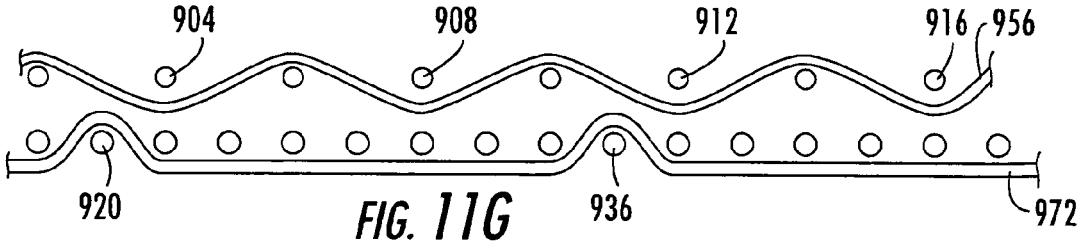
Figure 11H:
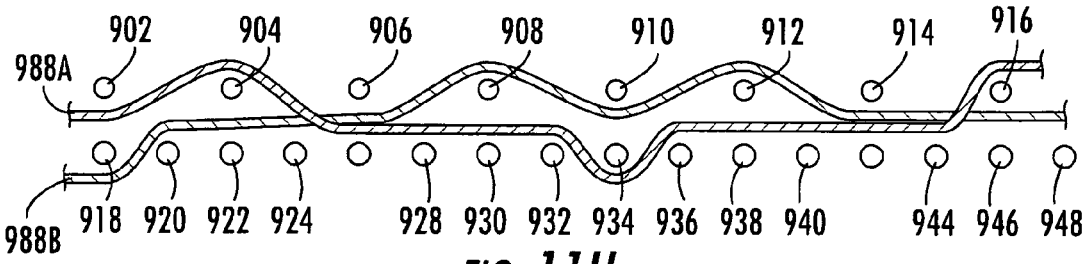
Figure 11I:
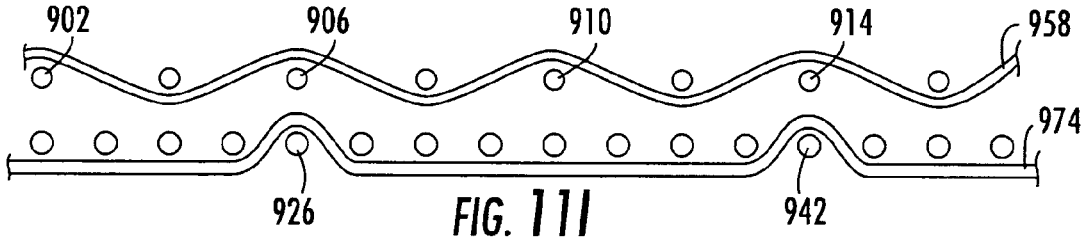
Figure 11J:
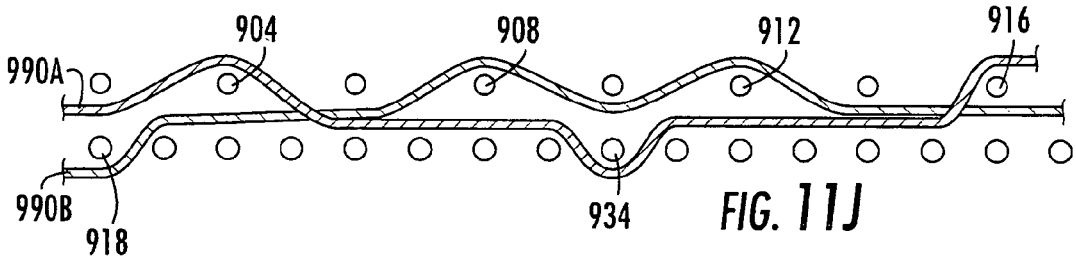
Figure 11K:
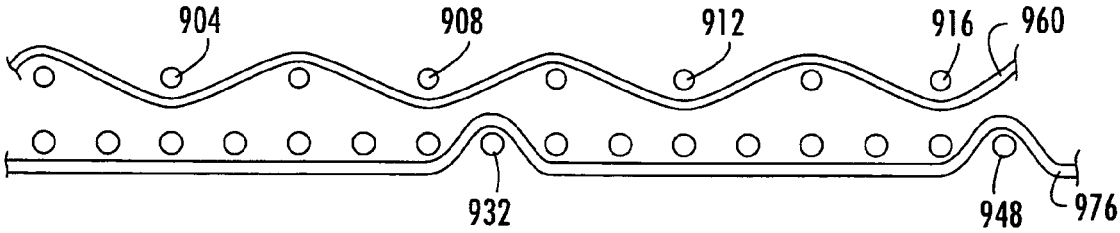
Figure 11L:
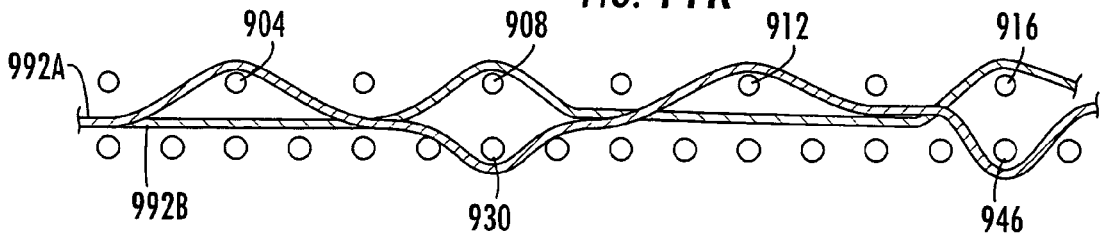
Figure 11M:
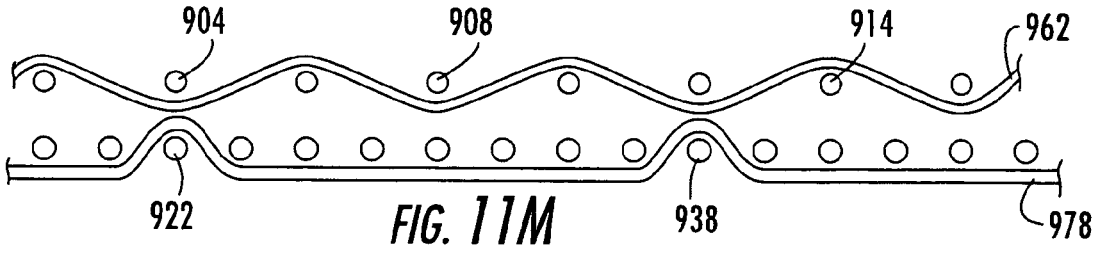
Figure 11N:
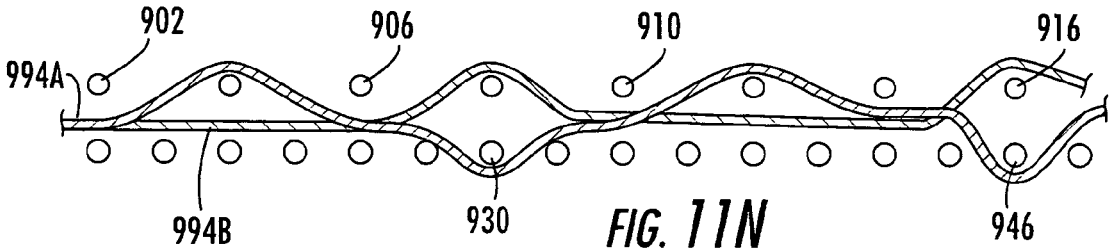
Figure 110:
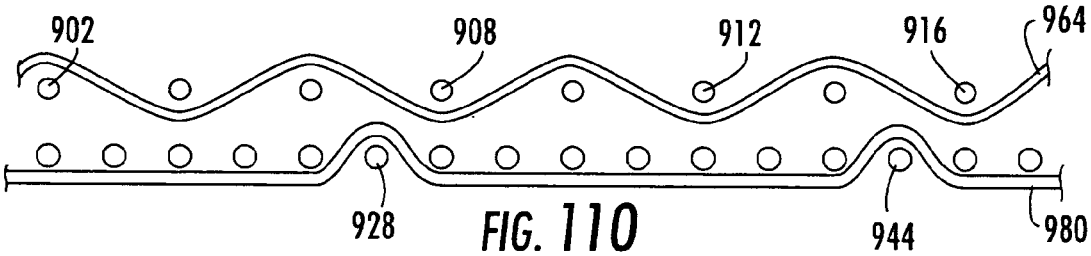
Figure 11P:
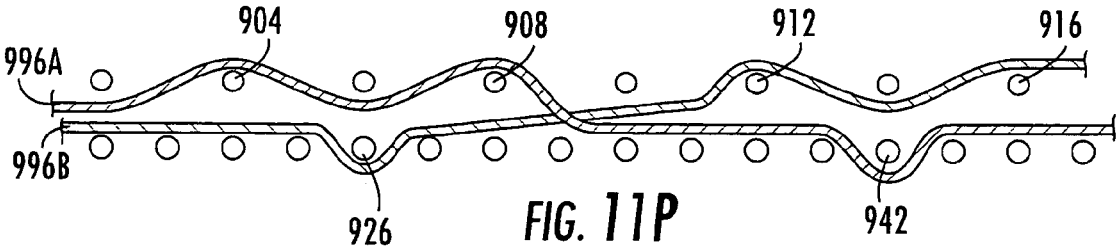

An alternative stitching yarn pattern, in which "pseudo-stitching" yarns are employed, is shown in fabric 900 in FIGS. 11A–11P. The fabric 900 includes eight top MD yarns 902, 904, 906, 908, 910, 912, 914, and 916 and sixteen bottom MD yarns 918, 920, 922, 924, 926, 928, 930, 932, 934, 936, 938, 940, 942, 944, 946 and 948. The bottom MD yarns 918, 920, 922, 924, 926, 928, 930, 932, 934, 936, 938, 940, 942, 944, 946 and 948 interweave with bottom CMD yarns 966, 968, 970, 972, 974, 976, 978, and 980 to form a bottom fabric layer in a weave pattern that is the same as the weave pattern in FIG. 2. That is, each bottom CMD yarn forms an "over 1/under 7/over 1/under 7" pattern with the sixteen bottom MD yarns.

The top MD yarns 902, 904, 906, 908, 910, 912, 914, and 916 interweave with top CMD yarns 950, 952, 954, 956, 958, 960, 962, and 964 and with stitching yarn pairs 982A, 982B, 984A, 984B, 986A, 986B, 988A, 988B, 990A, 990B, 992A, 992B, 994A, 994B, 996A, and 996B to form a plain weave pattern. As illustrated, two nearest adjacent stitching yarn pairs form the same pattern and include a pseudo-stitching yarn, i.e., a stitching yarn that does not stitch to the bottom layer, followed by two adjacent stitching yarn pairs that form the same pattern and do not include a pseudo-stitching yarn. For example, stitching yarn 984B is an example of a pseudo-stitching yarn. Pseudo-stitching yarn 984B passes under top MD yarn 902, over top MD yarn 904, under top MD yarns 906, 908, and 910, over top MD yarn 912, and under top MD yarns 914 and 916. On the other hand, stitching yarn 984A forms two binding knuckles with bottom MD yarns 922 and 938 and a fiber support portion at top MD yarns 906 and 914. Stitching yarn pair 986A, 986B form the same pattern as stitching yarn pair 984A, 984B.

Stitching yarn pair 988A, 988B forms the same pattern as stitching yarn pair 990A, 990B, respectively, and both stitching yarn pairs 988A, 988B and 990A, 990B do not include pseudo-stitching yarns. For example, stitching yarns 988B and 990B pass over bottom MD yarns 940, 942, 944, 946 and 948, under bottom MD yarn 918 to form a bottom binding knuckle and over bottom MD yarns 920, 922, 924, and 926. Stitching yarns 988B and 990B form a top fiber support portion by passing over top MD yarn 908, under top MD yarn 910, and over top MD yarn 912. Stitching yarns 988A and 990A form a top fiber support portion by passing over top MD yarn 916, under top MD yarn 902, and over top MD yarn 904. Stitching yarns 988A and 990A each form a bottom binding knuckle with bottom MD yarn 934.

Stitching yarn pairs 992A, 992B, 994A, 994B, 996A, 996B, 982A, and 982B are offset from stitching yarn pairs 984A, 984B, 986A, 986B, 988A, 988B, 990A, and 990B, respectively, by four bottom MD yarns, with stitching yarns 992B and 994B providing a pseudo-stitching yarn pattern.

Self-stitching yarn patterns may also be used in which the CMD yarns stitch the fabric layers together. An example of a twenty-four harness, self-stitched fabric 1000 having a top layer 1100 and a bottom layer 1200 is shown in FIGS. 12, 13 and 14A–14P. The fabric 1000 is stitched together by ones of the top CMD yarns.

Figure 13:
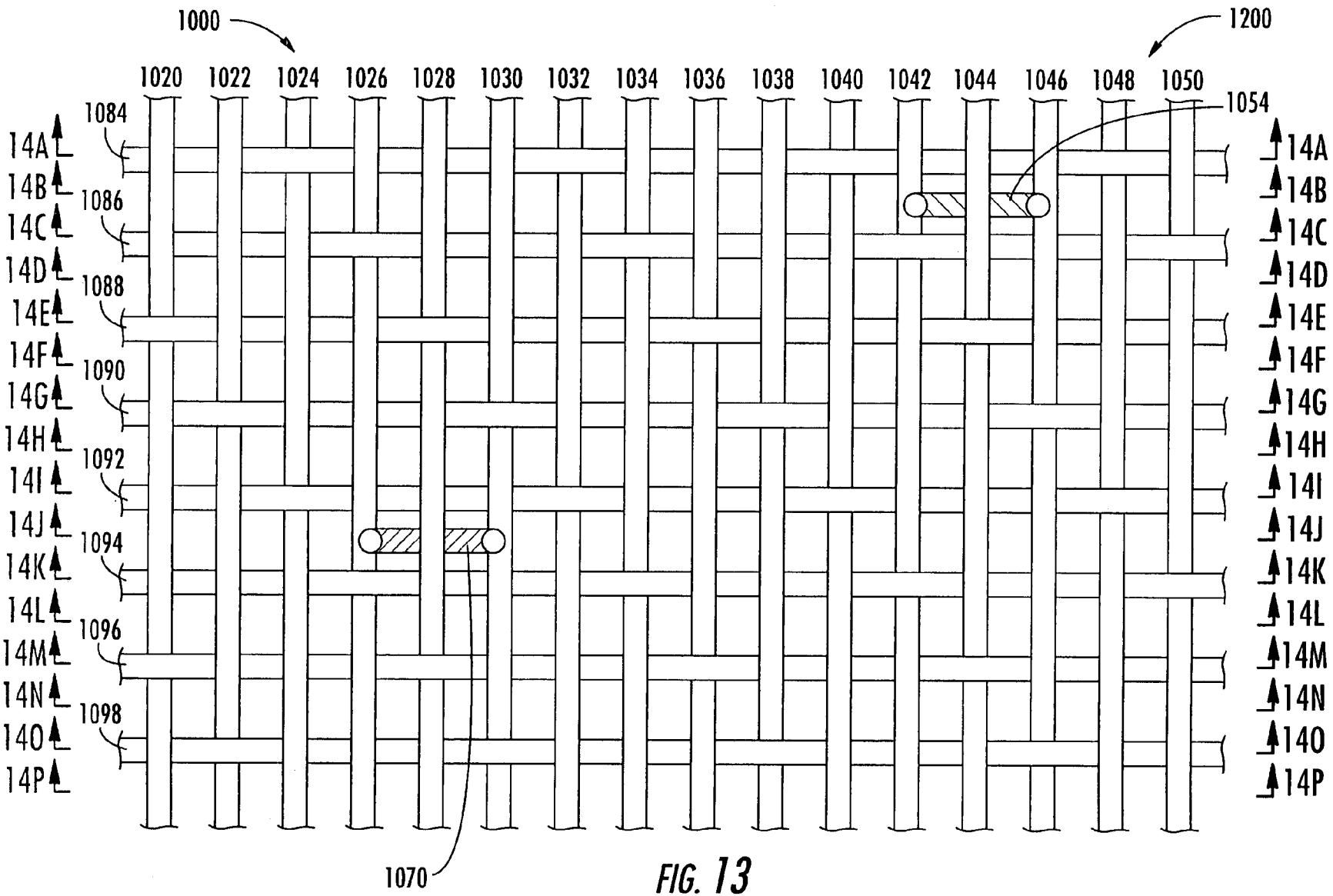
FIG. 13 is a top view of the bottom layer of the fabric of FIG. 12.
Figure 14A:
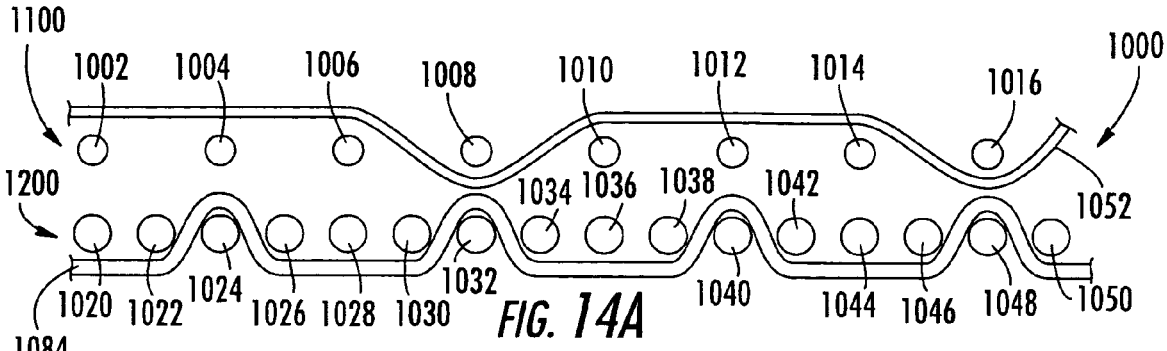
FIGS. 14A–14P are section views taken along lines 14A—14A to 14P—14P, respectively, of FIG. 12 of the fabric thereof.
Figure 14B:
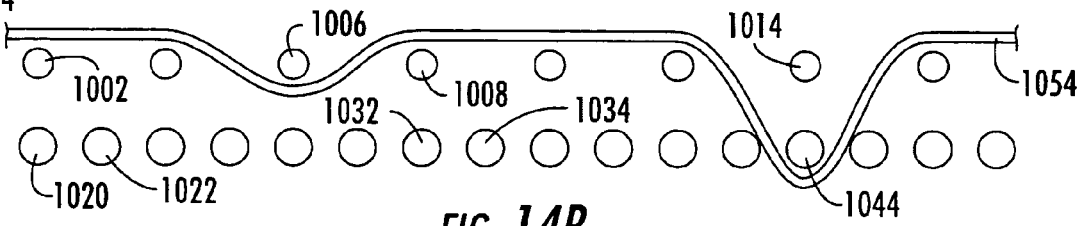
Figure 14C:
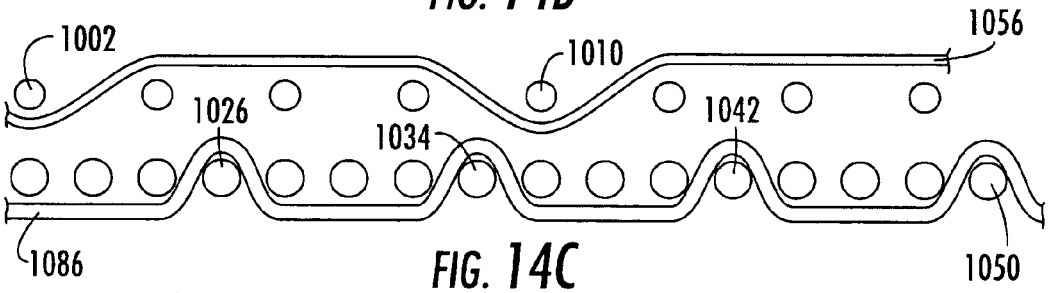
Figure 14D:
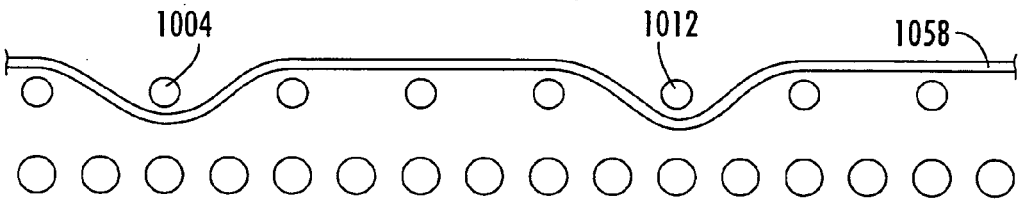
Figure 14E:
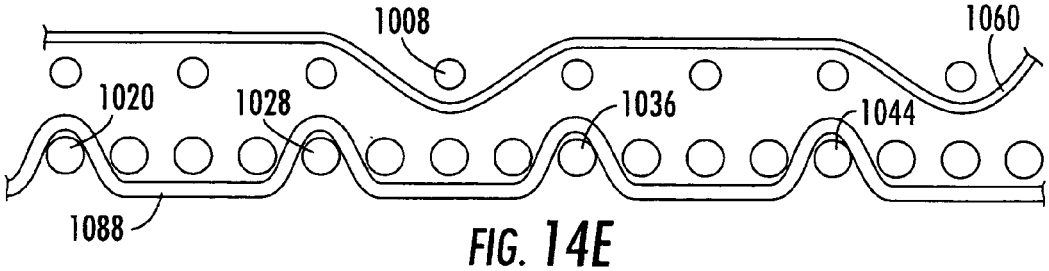
Figure 14F:
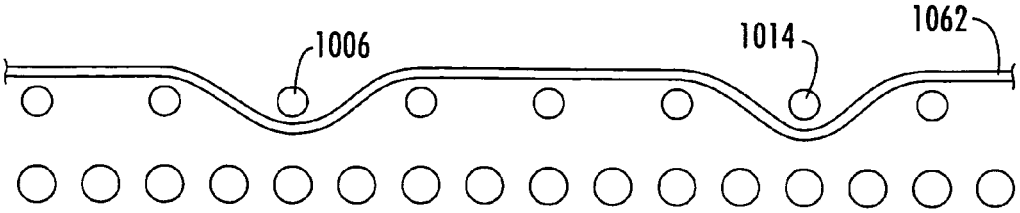
Figure 14G:
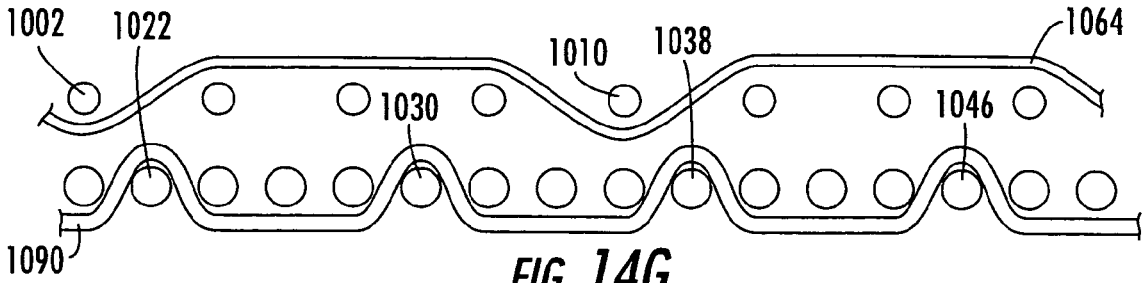
Figure 14H:
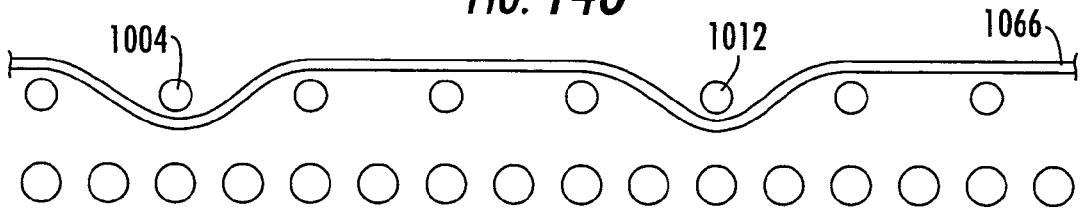
Figure 14I:
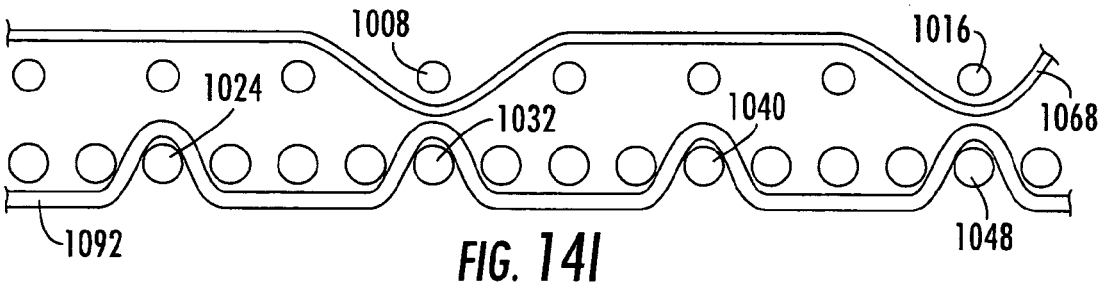
Figure 14J:
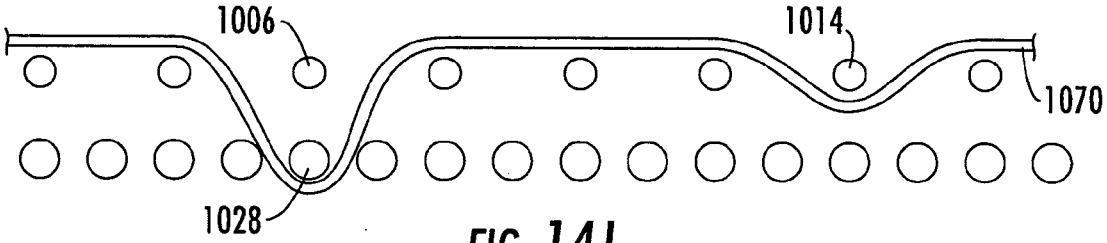
Figure 14K:
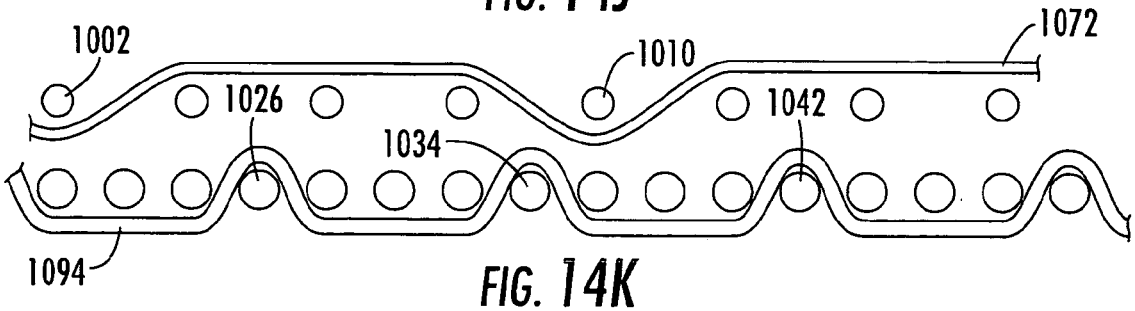
Figure 14L:
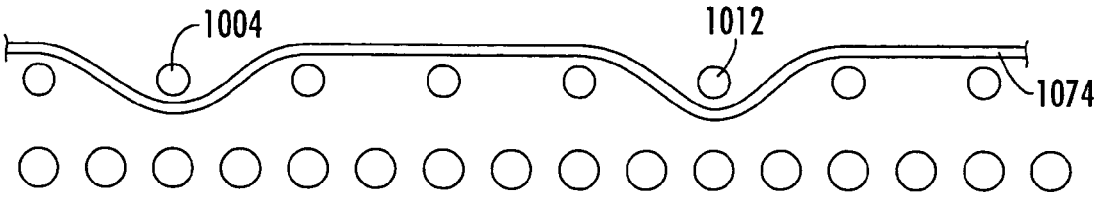
Figure 14M:
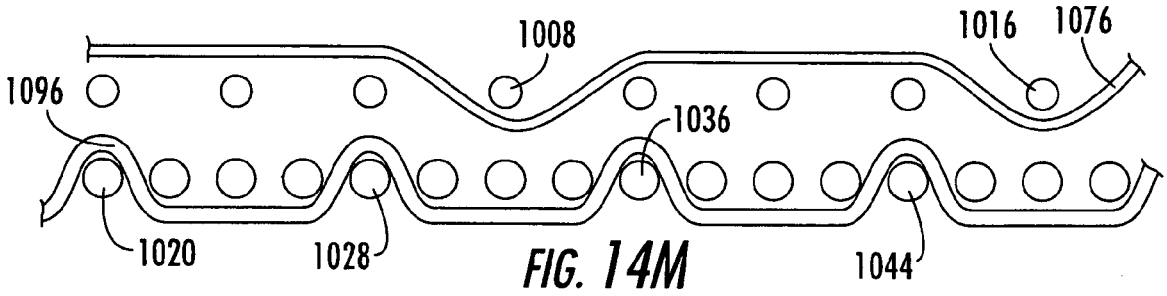
Figure 14N:
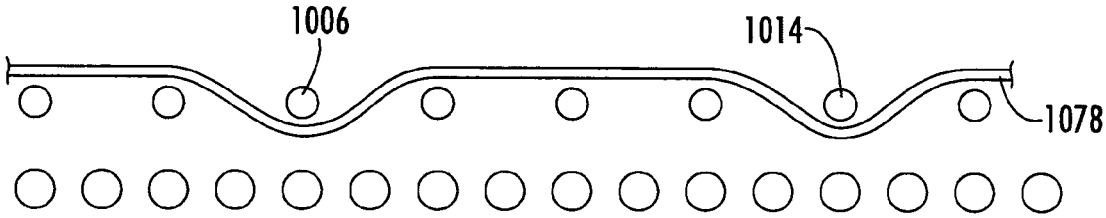
Figure 140:
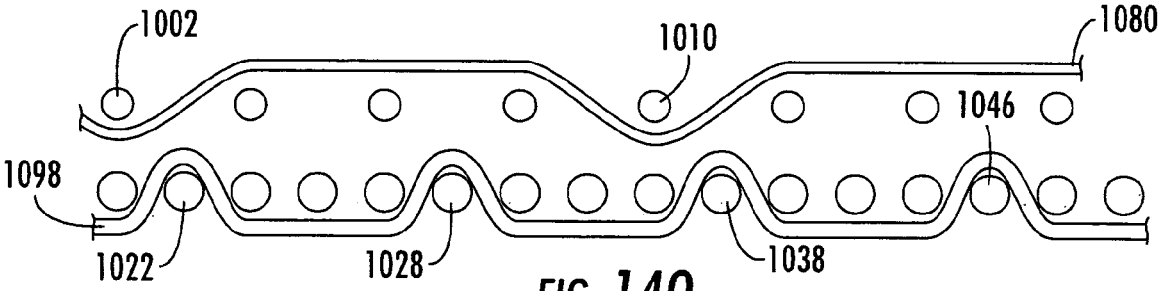
Figure 14P:
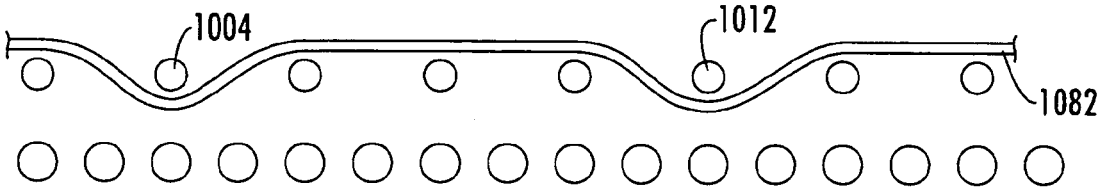

As illustrated in FIGS. 13 and 14A–14P, the bottom layer 1200 of the fabric 1000 includes sixteen bottom MD yarns 1020, 1022, 1024, 1026, 1028, 1030, 1032, 1034, 1036, 1038, 1040, 1042, 1044, 1046, 1048, and 1050 that interweave with eight bottom CMD yarns 1084, 1086, 1088, 1090, 1092, 1094, 1096, and 1098 in an "under 3/over 1" pattern. For example, as illustrated in FIG. 14E, bottom CMD yarn 1088 passes over bottom MD yarn 1020, under bottom MD yarns 1022, 1024, and 1026, over bottom MD yarn 1028, under bottom MD yarns 1030, 1032, and 1034 and so forth in an "under 3/over 1" pattern.

Figure 12:
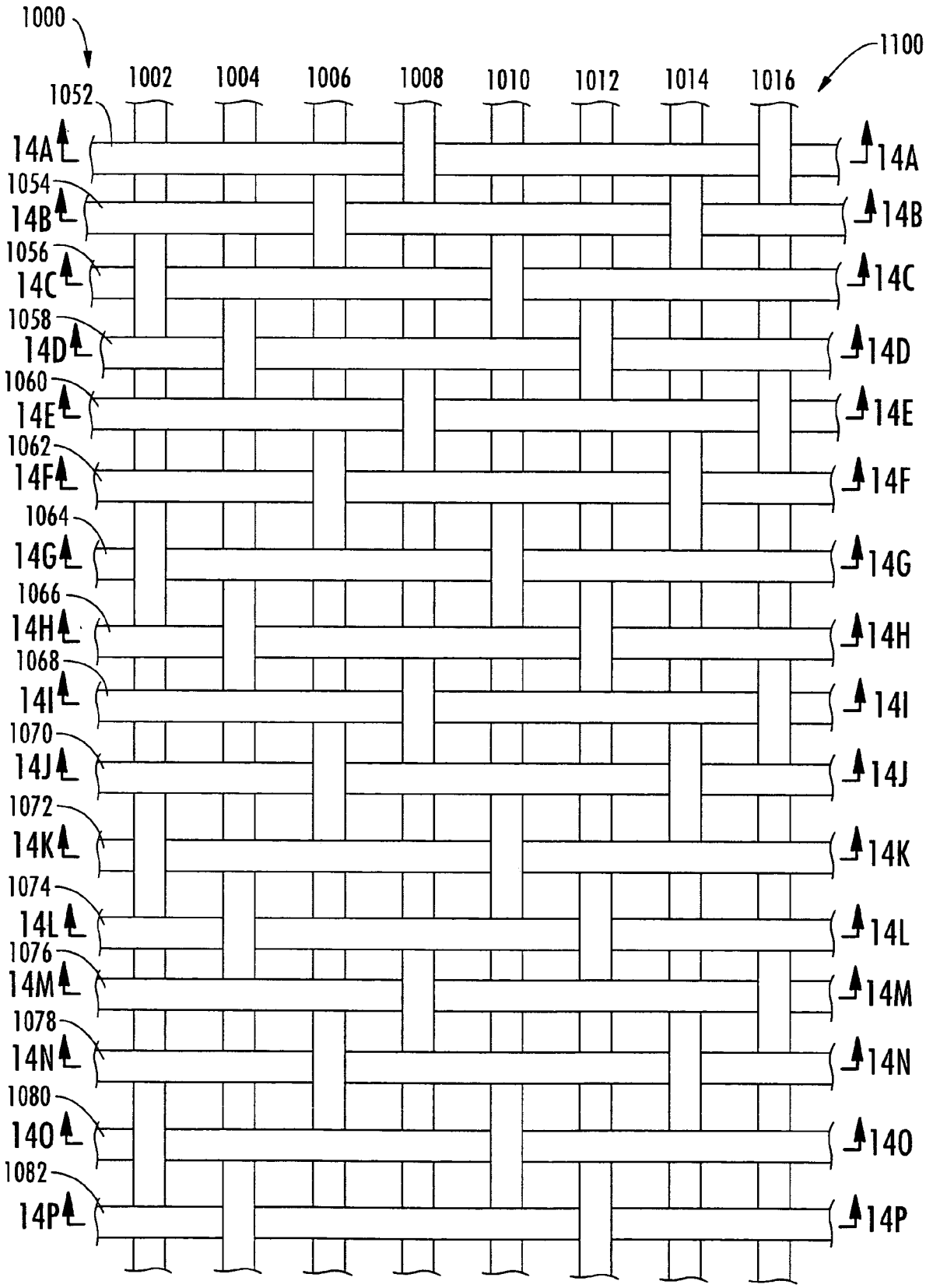
FIG. 12 is a top view of the top layer of a self-stitched, twenty-four harness papermaker's fabric according to embodiments of the present invention.

As illustrated in FIGS. 12 and 14A–14P, the top layer 1100 of the fabric 1000 includes eight top MD yarns 1002, 1004, 1006, 1008, 1010, 1012, 1014, and 1016 that interweave with sixteen top CMD yarns 1052, 1054, 1056, 1058, 1060, 1062, 1064, 1066, 1068, 1070, 1072, 1074, 1076, 1078, 1080 and 1082 in an "over 3/under 1" pattern with some of the top CMD yarns passing under a bottom MD yarn to stitch the top layer 1100 to the bottom layer 1200. More specifically, top CMD yarns 1054 and 1070 pass under bottom MD yarns 1044 and 1028, respectively, to stitch the top layer 1100 to the bottom layer 1200 of the fabric. For example, as illustrated in FIG. 14B, top CMD yarn 1054 passes over top MD yarns 1002 and 1004, under top MD yarn 1006 and over top MD yarns 1008, 1010, and 1012. Top CMD yarn 1054 then passes under bottom MD yarn 1044 to stitch the top layer 1100 and the bottom layer 1200 together.

As illustrated in FIGS. 14B and 14J, top CMD yarns 1054 and 1070 are used to stitch the top layer 1100 to the bottom layer 1200. It should be understood that other configurations of self-stitched fabrics can be used. For example, different top weave patterns and/or different bottom weave patterns, including various offsetting patterns, can be used. In some embodiments, the bottom CMD yarn is used to stitch the top and the bottom layers together. Moreover, various bottom CMD yarns can be used to stitch the top and bottom layers. For example, top CMD yarn 1052 could be used to stitch the top layer 1100 and the bottom layer 1200 by passing underneath bottom MD yarns 1032 and/or 1048.

Figure 15:
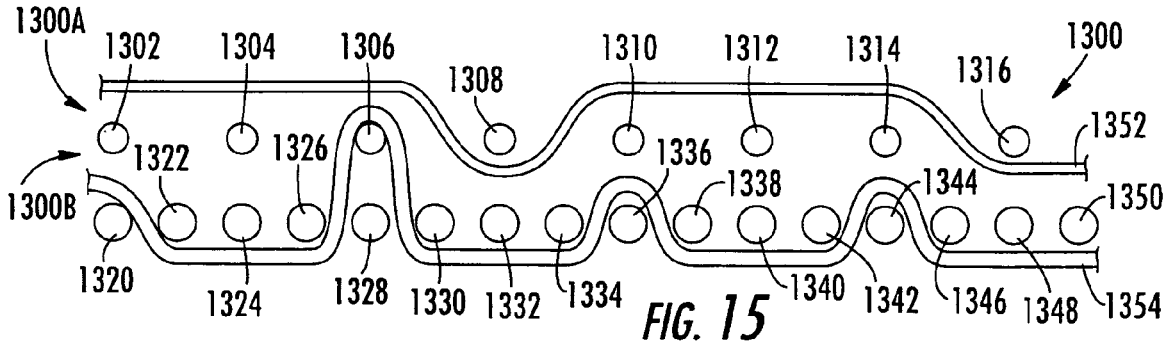
FIG. 15 is a section view of typical top and bottom CMD yarns as they interweave with top and bottom MD yarns in a self-stitching pattern of a twenty-four harness papermaker's fabric according to embodiments of the present invention.

As another example of a self-stitched fabric in which the bottom MD yarns are used to stitch the top and bottom layers is illustrated in FIG. 15. A fabric 1300 is shown having an exemplary top CMD yarn 1352 and bottom CMD yarn 1354. The bottom CMD yarn 1354 is used to stitch a top layer 1300A to a bottom layer 1300B. The top layer 1300A includes eight top MD yarns 1302, 1304, 1306, 1308, 1310, 1312, 1314, and 1416 the bottom layer 1300B includes sixteen bottom MD yarns 1320, 1322, 1324, 1326, 1328, 1330, 1332, 1334, 1336, 1338, 1340, 1342, 1344, 1346, 1348, and 1350. The top CMD yarn 1352 interweaves with the top MD yarns 1302, 1304, 1306, 1408, 1310, 1312, 1314, and 1416 in an "under 1/over 3" pattern.

The bottom CMD yarn 1354 interweaves with the bottom MD yarns 1320, 1322, 1324, 1326, 1328, 1330, 1332, 1334, 1336, 1338, 1340, 1342, 1344, 1346, 1348, and 1350 in an "over 1/under 3" pattern and passes over top MD yarn 1306 to stitch the top layer 1300A and the bottom layer 1300B together. That is, bottom CMD yarn 1354 passes over bottom MD yarn 1320 (and underneath top MD yarn 1302), under bottom MD yarns 1322, 1324, and 1326, over top MD yarn 1306, under bottom MD yarns 1330, 1332 and 1334 and so forth. It should be understood that the pattern illustrated in FIG. 15 can be repeated to form a repeat pattern, such as is illustrated with the fabric 1000 in FIGS. 12, 13 and 14A–14P. For example, the pattern illustrated in FIG. 15 can be repeated with an offset of one bottom MD yarn. Other offsetting patterns can be used.

Figure 16A:
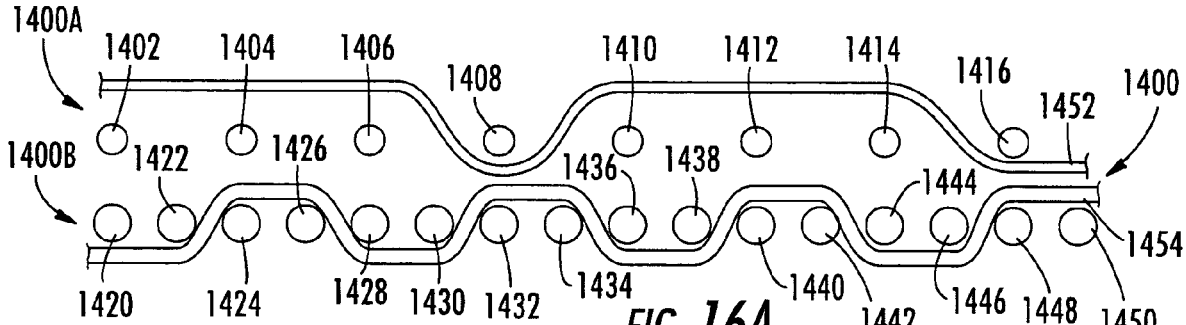
FIGS. 16A–16B are section views of typical top and bottom CMD yarns (FIG. 16A) and a typical self-stitching CMD yarn (FIG. 16B) as they interweave with top and bottom MD yarns of a twenty-four harness papermaker's fabric according to embodiments of the present invention.
Figure 16B:
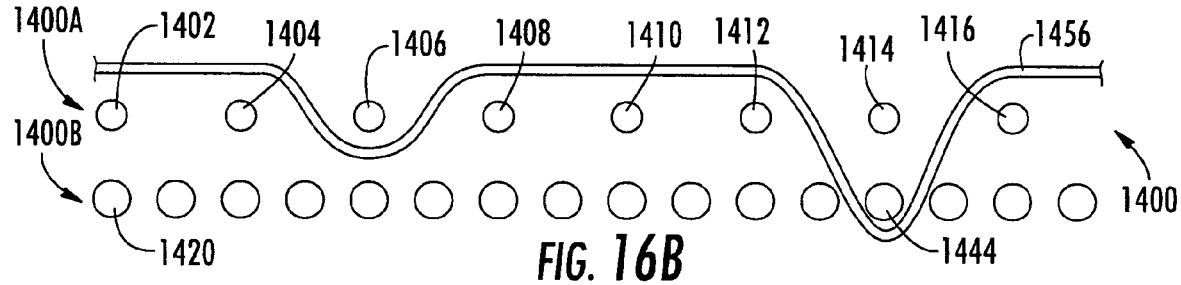

Another example of a self-stitched fabric is shown in the fabric 1400 of FIGS. 16A and 16B. The fabric 1400 includes a top layer 1400A having eight top MD yarns 1402, 1404, 1406, 1408, 1410, 1412, and 1416 and a bottom layer 1400B having sixteen bottom MD yarns 1420, 1422, 1424, 1426, 1428, 1430, 1432, 1434, 1436, 1438, 1440, 1442, 1444, 1446, 1448, and 1450.

The top MD yarns 1402, 1404, 1406, 1408, 1410, 1412, and 1416 interweave with exemplary top CMD yarns 1452 and 1456 in an "over 3/under 1" pattern. In addition, top CMD yarn 1456 stitches the top layer 1400A to the bottom layer 1400B. More specifically, top CMD yarn 1456 passes over top MD yarns 1402 and 1404, under top MD yarn 1406, over top MD yarns 1408, 1410 and 1412 and under bottom MD yarn 1444 and over top MD yarn 1416 to form the self-stitched pattern.

As illustrated in FIG. 16A, the bottom MD yarns 1420, 1422, 1424, 1426, 1428, 1430, 1432, 1434, 1436, 1438, 1440, 1442, 1444, 1446, 1448, and 1450 interweave with an exemplary bottom CMD yarn 1454 in an "under 2/over 2" pattern. That is, the bottom CMD yarn 1454 passes under bottom MD yarns 1420 and 1422, over bottom MD yarns 1424 and 1426, under bottom MD yarns 1428 and 1430 and so forth. It should be understood that the pattern illustrated in FIGS. 16A–16B can be repeated to form a repeat pattern, such as is illustrated with the fabric 1000 in FIGS. 12, 13 and 14A–14P.

It should be understood that various patterns of top and/or bottom layers can be used in a self-stitched pattern, including different weave patterns and different offsetting patterns. An example of a self-stitched fabric having a different bottom layer pattern is shown in the fabric 1500 of FIGS. 17A and 17B. The fabric 1500 includes a top layer 1500A having eight top MD yarns 1502, 1504, 1506, 1508, 1510, 1512, and 1516 and a bottom layer 1500B having sixteen bottom MD yarns 1520, 1522, 1524, 1526, 1528, 1530, 1532, 1534, 1536, 1538, 1540, 1542, 1544, 1546, 1548, and 1550.

The top MD yarns 1502, 1504, 1506, 1508, 1510, 1512, and 1516 interweave with exemplary top CMD yarns 1552 and 1556 in an "over 3/under 1" pattern. In addition, top CMD yarn 1556 passes over top MD yarns 1502 and 1504, under top MD yarn 1506, over top MD yarns 1508, 1510 and 1512 and under bottom MD yarn 1544 and over top MD yarn 1516 to form the self-stitched pattern.

Figure 17A:
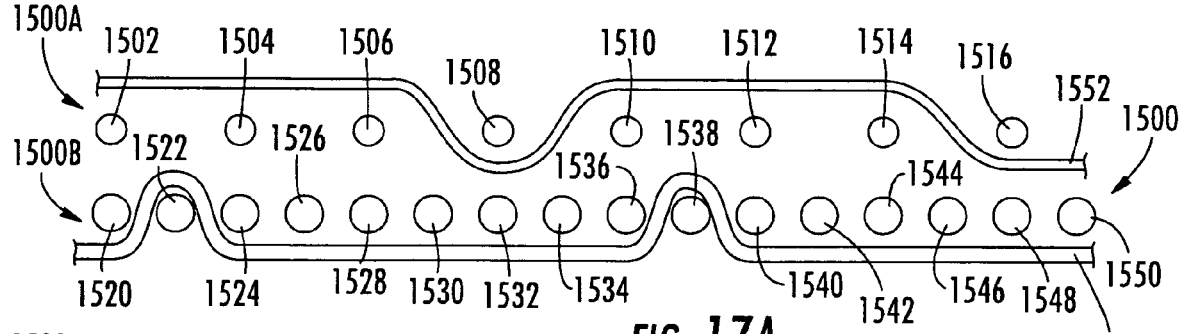
FIGS. 17A–17B are section views of typical top and bottom CMD yarns (FIG. 17A) and a typical self-stitching CMD yarn (FIG. 17B) as they interweave with top and bottom MD yarns of a twenty-four harness papermaker's fabric according to embodiments of the present invention.
Figure 17B:
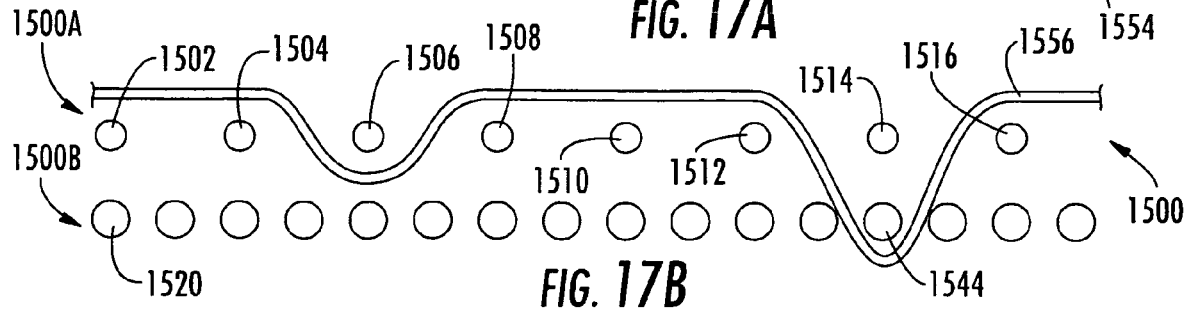

As illustrated in FIG. 17A, the bottom MD yarns 1520, 1522, 1524, 1526, 1528, 1530, 1532, 1534, 1536, 1538, 1540, 1542, 1544, 1546, 1548, and 1550 interweave with an exemplary bottom CMD yarn 1554 in an "over 1/under 7" pattern. That is, the bottom CMD yarn 1554 passes over bottom MD yarn 1522 and under bottom MD yarns 1524, 1526, 1528, 1530, 1532, 1534, and 1536, over bottom MD yarn 1538 and under bottom MD yarns 1540, 1542, 1544, 1546, 1548, 1550 and 1520. Other bottom or top layer fabric patterns can be used. It should be understood that the pattern illustrated in FIGS. 17A–17B can be repeated to form a repeat pattern, such as is illustrated with the fabric 1000 in FIGS. 12, 13 and 14A–14P.

The fabrics described herein can have the various yarn densities and/or diameters. For example, the total density of the MD yarns (both top MD yarns and bottom MD yarns) can be between about 30 and about 200 yarns per centimeter and/or the total density of the CMD yarns (both top CMD yarns and bottom CMD yarns can be between about 50 and about 200 yarns per centimeter. The top and/or bottom MD yarns can have a diameter of between about 0.05 and about 0.30 mm. The top and/or bottom CMD yarns can have a diameter of between about 0.05 and about 0.50 mm.

Generally speaking, yarn sizes should also be selected according to the desired papermaking properties of the fabric. As an example beyond the dimensions already discussed above, generally top and bottom MD yarns have a diameter of between about 0.12 to 0.15 mm, top CMD yarns have a diameter of between about 0.10 mm and 0.15 mm, bottom CMD yarns have a diameter of between about 0.16 mm and 0.22 mm, and stitching yarns have a diameter of between about 0.12 mm and 0.15 mm. In some embodiments, the yarn density of the top MD yarns is between about 25 and 50 yarns per centimeter, and the yarn density of the top CMD yarns is between about 42 and 50 yarns per centimeter.

As a specific example, the yarn densities and diameters for fabrics according to embodiments of the present invention may be as follows:

| | | |
|---|---|---|
| Top MD yarns | Diameter | 0.12 |
| | Density/cm | 25 |
| Top CMD yarns | Diameter | 0.11 |
| | Density/cm | 24 |
| Stitching yarns | Diameter | 0.11 |
| | Density/cm | 48 |
| Bottom MD yarns | Diameter | 0.15 |
| | Density/cm | 50 |
| Bottom CMD yarns | Diameter | 0.18 |
| | Density/cm | 24 |

The form of the yarns utilized in fabrics of the present invention can vary, depending upon the desired properties of the final papermaker's fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polypropylene, polyester, aramid, polyamide (nylon), or the like. The skilled artisan should select a yarn material according to the particular application of the final fabric. In particular, round monofilament yarns formed of polyester or polyamide are preferred.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention need not be provided herein.

The foregoing embodiments are illustrative of the present invention, and are not to be construed as limiting thereof. The invention is defined by the following claims, with equivalents of the claims to be included therein.

That which is claimed is:

1. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

wherein the bottom fabric layer is stitched to the top fabric layer via a set of stitching yarn pairs;

wherein the top machine direction yarns and the top cross machine direction yarns are interwoven in a series of repeat units and the bottom machine direction yarns and the bottom cross machine direction yarns are interwoven in a series of corresponding repeat units; and wherein each repeat unit has twice the number of bottom machine direction yarns as the number of top machine direction yarns; and wherein the set of stitching yarns comprises pairs of first and second stitching yarns positioned between pairs of adjacent top cross machine direction yarns; and wherein the pairs of first and second stitching yarns are interwoven with the top machine direction yarns and the bottom machine direction such that the top cross machine direction yarns and the first and second stitching yarns form a plain weave pattern with the top machine direction yarns.

2. The papermaker's fabric defined in claim 1, wherein the number of top cross machine direction yarns is the same as the number of bottom cross machine direction yarns.

3. The papermaker's fabric defined in claim 1, wherein the set of bottom cross machine direction yarns comprises sixteen bottom machine direction yarns.

4. The papermaker's fabric defined in claim 3, wherein the bottom machine direction yarns and the bottom cross machine direction yarns are interwoven in a series of repeat units in which each bottom machine direction yarn passes below one bottom cross machine direction yarn to form a bottom machine direction knuckle, bottom machine direction knuckles under a common bottom cross machine direction yarn being separated by seven bottom machine direction yarns.

5. The papermaker's fabric defined in claim 4, wherein each of the bottom machine direction knuckles under a common cross machine direction yarn is offset from the bottom machine direction knuckles formed by adjacent bottom cross machine direction yarns by three cross machine direction yarns.

6. The papermaker's fabric defined in claim 5, wherein the stitching yarns and the bottom machine direction yarns are interwoven in a series of repeat units in which the stitching yarns pass below bottom machine direction yarns to form stitching yarn knuckles, the stitching yarn knuckles between a common pair of cross machine direction yarns being separated by seven bottom machine direction yarns.

7. The papermaker's fabric defined in claim 6, wherein each of the bottom stitching yarn knuckles formed by one stitching yarn pair is offset from the bottom stitching yarn knuckles formed by an adjacent stitching yarn pair by three bottom machine direction yarns.

8. The papermaker's fabric defined in claim 3, wherein the bottom machine direction yarns and the bottom cross machine direction yarns are interwoven in a series of repeat units in which each bottom cross machine direction yarn passes above two adjacent bottom machine direction yarns to form a pair of adjacent bottom machine direction knuckles, below four adjacent bottom machine direction yarns, above one bottom machine direction yarn to form a first additional bottom machine direction knuckle, below four adjacent bottom machine direction yarns, and above one bottom machine direction yarn to form a second additional bottom machine direction knuckle.

9. The papermaker's fabric defined in claim 8, wherein the pair of bottom machine direction knuckles and the first and second additional bottom machine direction knuckles formed by adjacent cross machine directions yarn are offset by three bottom machine direction yarns.

10. The papermaker's fabric defined in claim 3, wherein at least one of the stitching yarn pairs forming a fiber support portion by interweaving with the top machine direction yarns and forming a binding portion by interweaving with the bottom machine direction yarns so that the binding portion of the stitching yarns passes below bottom machine direction yarns to form stitching yarn knuckles, the stitching yarn knuckles between a common pair of cross machine direction yarns being separated by seven bottom machine direction yarns, at least one other of the stitching yarn pairs being a pair of pseudo stitching yarns that interweave with the top machine direction yarns to form a plain weave pattern without forming a stitching yarn knuckle.

11. The papermakers fabric defined in claim 1, wherein the set of bottom cross machine direction yarns comprises sixteen bottom machine direction yarns and wherein the set of stitching yarn pairs comprises pairs of first and second stitching yarns, the first and second stitching yarns forming two different bottom machine direction binding knuckles per repeat unit, and the first and second stitching yarns forming alternating top machine direction fiber support knuckles.

12. The papermaker's fabric defined in claim 11, wherein each stitching yarn in the stitching yarn pair forms first and second fiber support portions by interweaving with three consecutive top machine direction yarns to pass over the first consecutive top machine direction yarn, under the second consecutive top machine direction yarn, and over the third consecutive top machine direction yarn, the first and second fiber support portions being separated by first and second binding knuckles formed by the stitching yarn passing under a bottom machine direction knuckle.

13. The papermakers fabric defined in claim 1, wherein the set of bottom cross machine direction yarns comprises twenty bottom machine direction yarns.

14. The papermaker's fabric defined in claim 13, wherein the bottom machine direction yarns and the bottom cross machine direction yarns are interwoven in a series of repeat units in which each of the bottom cross machine direction yarns pass above two bottom machine direction yarns to form adjacent bottom machine direction knuckles, each pair of bottom machine direction knuckles under a common bottom cross machine direction yarn being separated by eight bottom machine direction yarns.

15. The papermaker's fabric defined in claim 1, wherein the set of bottom cross machine direction yarns comprises twenty-four bottom machine direction yarns.

16. The papermaker's fabric defined in claim 15, wherein the bottom machine direction yarns and the bottom cross machine direction yarns are interwoven in a series of repeat units in which each of the bottom cross machine direction yarns pass above two bottom machine direction yarns to form bottom machine direction knuckles, each pair of bottom machine direction knuckles under a common bottom cross machine direction yarn being separated by ten bottom machine direction yarns.

17. The papermaker's fabric defined in claim 1, wherein the top and bottom machine direction yarns have a density of between about 30 and about 200 per centimeter.

18. The papermaker's fabric defined in claim 1, wherein the top and bottom cross machine direction yarns have a density of between about 50 and about 200 per centimeter.

19. The papermaker's fabric defined in claim 1, wherein the machine direction yarns have a diameter of between about 0.05 and about 0.30 millimeters.

20. The papermaker's fabric defined in claim 1, wherein the cross machine direction yarns have a diameter of between about 0.05 and about 0.50 millimeters.

21. The papermakers fabric defined in claim 1, the fabric having a warp resistance factor of between about 1.2 and about 3.0.

22. A papermaker's fabric, comprising top machine direction yarns, top cross machine direction yarns, bottom machine direction yarns, bottom cross machine direction yarns and stitching yarns, the fabric being formed in a plurality of repeating units, each of the repeating units comprising:

a set of eight top machine direction yarns;

a set of top cross machine direction yarns interwoven with the set of top machine direction yarns to form a top fabric layer;

a set of sixteen bottom machine direction yarns;

a set of bottom cross machine direction yarns interwoven with the set of bottom machine direction yarns to form a bottom fabric layer; and sets of first and second stitching yarns interwoven with the top and bottom fabric layers;

wherein the bottom machine direction yarns and the bottom cross machine direction yarns are interwoven in a series of repeat units in which the bottom cross machine direction yarns pass above bottom machine direction yarns to form bottom machine direction knuckles, each bottom machine direction knuckle under a common bottom cross machine direction yarn being separated by seven bottom machine direction yarns.

23. The papermakers fabric defined in claim 22, wherein each of the bottom machine direction yarns is offset from adjacent bottom machine direction yarns by three cross machine direction yarns.

24. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

wherein the bottom fabric layer is stitched to the top fabric layer via a set of stitching yarns;

wherein the top machine direction yarns and the top cross machine direction yarns are interwoven in a series of repeat units and the bottom machine direction yarns and the bottom cross machine direction yarns are interwoven in a series of corresponding repeat units; and wherein each repeat unit has twice the number of bottom machine direction yarns as the number of top machine direction yarns; and wherein the set of stitching yarns comprises pairs of first and second stitching yarns positioned between pairs of adjacent top cross machine direction yarns; and wherein the pairs of first and second stitching yarns are interwoven with the top machine direction yarns and the bottom machine direction such that the top cross machine direction yarns and the first and second stitching yarns form a plain weave pattern with the top machine direction yarns; and wherein a stitching yarn passes below each of the bottom machine direction yarns and forms a knuckle thereunder.

25. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer; and a set of stitching yarn pairs interwoven with the top and bottom fabric layers in a series of repeat units, the set of stitching yarn pairs comprising pairs of first and second stitching yarns positioned between pairs of adjacent top cross machine direction yarns, wherein the top machine direction yarns and the top cross machine direction yarns are interwoven in a series of repeat units and the bottom machine direction yarns and the bottom cross machine direction yarns are interwoven in a series of corresponding repeat units; and further comprising a set of stitching yarn pairs interwoven with the top and bottom fabric layers in a series of repeat units, the set of stitching yarn pairs comprising pairs of first and second stitching yarns positioned between pairs of adjacent top cross machine direction yarns;

wherein each repeat unit has twice the number of bottom machine direction yarns as the number of top machine direction yarns;

at least one of the stitching yarn pairs forming a fiber support portion by interweaving with the top machine direction yarns and forming a binding portion by interweaving with the bottom machine direction yarns so that the binding portion of the stitching yarns passes below bottom machine direction yarns to form stitching yarn knuckles;

at least one other of the stitching yarn pairs being a pair of pseudo stitching yarns that interweave with the top machine direction yarns to form a plain weave pattern without forming a stitching yarn knuckle.

* * * * *

UNITED STATES PATENT AND TRADEMARK OFFICE

CERTIFICATE OF CORRECTION

PATENT NO. : 7,243,687 B2
APPLICATION NO. : 10/862782
DATED : July 17, 2007
INVENTOR(S) : Christine Barratte It is certified that error appears in the above-identified patent and that said Letters Patent is hereby corrected as shown below:

Column 18, Claim 3, Line 28: Please delete "cross"

Column 18, Claim 5, Lines 43-44: Please correct "by three cross machine direction yarns."
to read -- by three bottom machine direction yarns. --

Column 19, Claim 11, Line 24: Please delete "cross"

Column 19, Claim 13, Line 42: Please delete "cross"

Column 19, Claim 15, Line 54: Please delete "cross"

Column 20, Claim 23, Lines 40-41: Please correct "by three cross machine direction yarns."
to read -- by three bottom machine direction yarns. --

Signed and Sealed this

Thirteenth Day of April, 2010

David J. Kappos

David J. Kappos
*Director of the United States Patent and Trademark Office*